US006367179B1

(12) United States Patent
Marsh

(10) Patent No.: US 6,367,179 B1
(45) Date of Patent: Apr. 9, 2002

(54) ILLUMINATED DISPLAY SIGN APPARATUS AND METHOD FOR INSTALLING THE SAME

(75) Inventor: Brent Marsh, San Francisco, CA (US)

(73) Assignee: BJI Energy Solutions, LLC, New York, NY (US)

( * ) Notice: Subject to any disclaimer, the term of this patent is extended or adjusted under 35 U.S.C. 154(b) by 0 days.

(21) Appl. No.: 09/310,451

(22) Filed: May 12, 1999

Related U.S. Application Data

(63) Continuation-in-part of application No. 08/630,361, filed on Apr. 10, 1996, now Pat. No. 6,135,620.

(51) Int. Cl.[7] ..... G09F 13/06

(52) U.S. Cl. ..... 40/570; 362/377; 362/223; 313/25

(58) Field of Search ..... 40/564, 572, 570, 40/580; 362/217, 224, 249, 260, 812

(56) References Cited

U.S. PATENT DOCUMENTS

| | | | | |
|---|---|---|---|---|
| 3,156,841 A | | 11/1964 | Ayres | 313/49 |
| 3,772,559 A | | 11/1973 | Schoke | 313/269 |
| 4,229,780 A | | 10/1980 | Nelson | 362/218 |
| 4,271,621 A | | 6/1981 | Garcia et al. | 40/570 |
| 4,554,619 A | * | 11/1985 | Bansbach et al. | 362/222 |
| 4,650,265 A | | 3/1987 | Holtzman | 339/1 |
| 4,924,368 A | | 5/1990 | Northrop et al. | 362/376 |
| 4,991,070 A | | 2/1991 | Stob | |
| 5,020,252 A | | 6/1991 | De Boef | 40/564 |
| 5,063,486 A | * | 11/1991 | Cummings, III et al. | 40/564 X |
| 5,105,568 A | | 4/1992 | Branning | 40/570 |
| 5,291,379 A | | 3/1994 | Lu | 362/255 |
| 5,349,508 A | | 9/1994 | Karbaf | 362/217 |
| 5,388,357 A | | 2/1995 | Malita | 40/570 |
| 5,394,314 A | | 2/1995 | Evanisko | 362/216 |
| 5,410,454 A | | 4/1995 | Murase et al. | 362/31 |
| 5,459,955 A | | 10/1995 | Ruskouski et al. | 40/570 |
| 5,469,347 A | | 11/1995 | Duve et al. | 362/245 |
| 5,485,145 A | | 1/1996 | Sniff | 340/815.4 |
| 5,510,965 A | | 4/1996 | Teakell | 362/223 |
| 5,539,623 A | | 7/1996 | Gurz et al. | 362/20 |
| 5,585,694 A | | 12/1996 | Goldburt et al. | 313/491 |
| 5,588,738 A | * | 12/1996 | Meoli | 362/184 |
| 5,608,288 A | | 3/1997 | Haag | 313/612 |
| 5,649,759 A | * | 7/1997 | Korte | 362/226 |
| 5,742,497 A | | 4/1998 | Hashimoto et al. | 363/133 |
| 5,814,938 A | | 9/1998 | Beland et al. | 315/3 |
| 5,847,550 A | | 12/1998 | Schie et al. | 323/222 |
| 6,135,620 A | * | 10/2000 | Marsh | 362/377 |

* cited by examiner

*Primary Examiner*—Brian K. Green
(74) *Attorney, Agent, or Firm*—Kleinberg & Lerner, LLP; Marvin H. Kleinberg

(57) ABSTRACT

An optical chassis utilizes optical couplers to convert the radial optical distribution of tube-shaped lamps into a more uniform optical distribution on planar illuminated surfaces. An optical chassis designed as an illumination source for emergency exit signs has two lamps and two optical couplers spaced apart on the optical chassis with a voltage converter disposed between the optical couplers. Illumination efficiency and uniformity is improved so that the optical chassis satisfies Underwriter's Laboratory standards for emergency exit sign retrofit kits.

20 Claims, 16 Drawing Sheets

ILLUMINATED DISPLAY SIGN APPARATUS AND METHOD FOR INSTALLING THE SAME

This application is a continuation-in-part of U.S. patent application Ser. No. 08/630,361, entitled "CCFL Illuminated Device And Method Of Use," filed Apr. 10, 1996, now U.S. Pat. No. 6,135,620.

FIELD OF THE INVENTION

The present invention relates generally to an illumination source for illuminating a planar surface with a small number of tube-shaped lamps. More particularly, the present invention is directed towards an illumination source for emergency exit signs and emergency exit sign retrofit kits.

BACKGROUND OF THE INVENTION

An illuminated display sign generally comprises a light source to illuminate a display surface upon which words, symbols, or other indicia are imprinted. Illuminated display signs include a variety of advertising signs, household number display signs, information bearing signs, and a variety of emergency information signs.

As shown in FIG. 1, a common illuminated display sign is an emergency exit sign. Although there are a variety of exit sign configurations, a common prior art emergency exit sign 10 utilizes a rectangular shaped frame, and is commonly known as a "box type" emergency exit sign. Two surfaces 12, 24 of the exit sign 10 are used to display information. Stencil signs have translucent letters and opaque backgrounds. Panel signs have white translucent backgrounds and translucent letters. The display surfaces 12, 24 of emergency exit sign 10 include directional arrows 16 and letters 18 forming the word "exit."

A variety of local regulations, safety organizations, and customs govern the exact size and placement of directional arrows 16 and letters 18 so that there are currently several different size and styles of box-type exit signs installed throughout the United States. The rectangular frame size varies across the United States, but typically is between 8"-to-14" wide, 7"-to-11" high, and 1.75"-to-4" deep. The exit sign letters are typically between 6.0"-to-8" tall and ¾" wide. The directional arrows 16 are typically disposed to the sides of the letters 18, but are also sometimes placed below the letters.

A suitable light source is required to illuminate the arrows 16 and letters 18 of an emergency exit sign 10. FIG. 2 shows a perspective view of the interior of a prior art exit sign with one exterior surface 12 removed for the purpose of illustrating the interior illumination means. Exit signs 210 of the type show are commonly manufactured with two sockets 220 to hold two incandescent bulbs 230. The sockets are typically spaced apart along an upper edge 240 of the sign 210. The incandescent bulbs 230 typically comprise two twenty-watt incandescent lamps.

The cost of operating a single emergency exit sign 210 utilizing incandescent-bulbs 230 can be significant. In addition to the cost of the electricity, the bulbs must be replaced biannually because of the limited operating lifetime of common incandescent bulbs. The average annual operating cost of one emergency exit sign typically averages about $50 per year.

The development of high efficiency light-emitting diodes (LEDs) permits LEDs to be used instead of incandescent bulbs. A single LED has a light output that is highly directional and confined to a narrow cone of emission angles, which makes it difficult to use a small number of LEDs to brightly illuminate an emergency exit sign. Consequently, the light output from a large number of individual LEDs, each disposed at different locations and/or pointed in different directions, is typically needed to brightly illuminate an emergency exit sign. Exit signs utilizing an illumination source comprised of LEDs use about 90% less power than incandescent bulbs and have an output illuminance above the minimum brightness requirement required by Underwriter's Laboratory® requirements which can be maintained for a useful lifetime of about 3–10 years. The power output of LEDs depends upon the color (wavelength) of the LED emission. Generally, the most efficient LEDs have a light with a red (long wavelength) color light output, although substantially dimmer LEDs with a green (short wavelength) output are commercially available as well. However, green LEDs with an output power comparable to red LEDs are now commercially available. Because of the monochromatic (single color) output of LEDs, they are best suited for illuminating stencil signs. Currently, about 80% of manufactured red stencil signs are illuminated by LEDs. This is in contrast to the early 1990s, when about 80% of exit signs were illuminated with incandescent lamps.

The standards for brightness and uniformity of illumination of the arrows 16 and letters 18 of an exit sign 10 have become more stringent in recent years in order to address concerns about public safety. A brighter, more uniformly illuminated emergency exit sign is easier to read under a variety of background illumination conditions and/or from a greater distance.

There are currently two separate sets of Underwriter's Laboratory® (UL) standards for emergency exit signs under the UL 924 standard which was issued August, 1997. The first set of standards is for new exit signs. New exit signs must have a minimum brightness of 2.5 foot lamberts (FL) as measured along each of twenty different points. The twenty measurement points of the UL 924 standard along different portions of the letters 18 of an emergency exit sign is shown in FIG. 3. There is also a minimum uniformity ratio (UR) requirement in regards to the maximum/minimum intensity of any two of the twenty points. New exit signs must have a maximum UR of 50:1 over the letters 18 and arrows 16, which means that the dimmest of the twenty measured points can have an optical intensity that is at most fifty times lower than the brightest of the twenty points.

A variety of conventional illumination sources may be used to satisfy the UL 924 standard for new exit signs. For example, conventional LED illumination sources used in emergency exit signs typically direct the light output of a large number of individual LEDs to illuminate the letters 18 of an exit sign. Conventional LED illumination source configurations produce an output of about 3 to 8 FL, which diminishes with age to 2.5 FL in a time period of six months-to-ten years.

The second set of UL 924 standards is for retrofit kits, with these standards being more stringent than for new exit signs. Retrofit kits include any kit to replace the standard light source of a conventional exit sign with another light source, such as an energy efficient LED light source. A retrofit kit must be capable of illuminating the letters of a retrofitted exit sign with a minimum brightness at each measurement point in excess of 6 FL and a UR of 20:1. These standards are so stringent that they exceed brightness levels achieved in conventional LED illumination sources (i.e., using common numbers and configurations of LEDs) used in new emergency exit signs.

The problem of designing a retrofit kit to satisfy the UL 924 retrofit standard is exacerbated by the many different sizes and styles of a box-exit sign currently in existence. Under the old retrofit standards, a LED illumination source with a modest number of LEDs could satisfy the illumination requirements of a variety of box-type emergency exit stencil signs. However, under the new retrofit standards, a comparatively large number of LEDs are required to form an illumination source that is bright enough and uniform enough to satisfy the present retrofit standards. Consequently, the cost of an LED retrofit kit is prohibitive when compared to the fewer LEDs needed in a new sign. Several manufacturers have ceased selling LED retrofit kits in favor of selling new exit signs. Unfortunately, the lack of LED retrofit kits may delay the conversion of the estimated 100-to-150 million emergency exit signs in the United States to more energy efficient illumination means. Even if LED illumination sources were suitable for retrofitting stencil-type signs, they are unsuitable for retrofitting panel signs because conventional LEDs have a substantially monochromatic light output. Panel signs require a white-light source to illuminate their translucent letters and white translucent background. Unfortunately, conventional retrofit kits utilizing miniature fluorescent lamps as the illumination source are also unable to satisfy the UL standard for retrofit kits.

Generally, the evolving illumination standards for emergency exit signs makes it difficult to achieve a low-cost, low power consumption, long-life, bright, and uniformly illuminated display surface, particularly in the context of retrofit kits using LEDs. While this is an important concern for emergency exit signs, many of the same considerations also apply to a variety of other illuminated display signs. For example, the illumination of directional pointing arrows, household number signs, and a variety of advertising signs is beneficially improved if the brightness, UR, and energy efficiency is improved. For example, an illuminated display sign to display a home street address number (e.g., "1010") at night is beneficially improved if the brightness and UR is improved so that the address may be read from a greater distance.

What is desired is an improved illumination means for illuminating display signs that overcomes the limitations of conventional sources to achieve improved uniformity and illumination intensity in an energy efficient configuration.

SUMMARY OF THE INVENTION

The present invention is directed towards the use of energy efficient miniature lamps, such as cold cathode fluorescent lamps, to illuminate display surfaces, such as those in emergency exit signs, in a substantially uniform manner. The present invention solves the problem of using a small number of miniature tube-shaped lamps to illuminate emergency exit signs, but may be used in other applications as well.

The present invention generally comprises an optical chassis for illuminating a display surface having: a frame; an optical coupler mechanically coupled to said frame having an inner chamber and an outer surface; a tube-shaped lamp with a diameter less than the diameter of the chamber; and a mechanical coupler to suspend said lamp within the center of said chamber while permitting the lamp to flex along its length in response to vibration; wherein the optical characteristics of the optical coupler are selected to alter the trajectory of light rays passing through the optical coupler to improve the uniformity of optical illumination on the planar surface region.

One object of the present invention is an emergency exit sign comprising two optical couplers spaced apart to illuminate the display surfaces of an emergency exit sign.

Another object of the present invention is an emergency exit sign retrofit kit that includes mechanical connectors to lock the optical chassis into pre-existing box-type exit signs. In a preferred embodiment, a ballast compartment is disposed between two optical couplers on an optical chassis, thereby eliminating deleterious shadowing that could occur if the ballast was located outside of the optical chassis.

Still another aspect of the present invention is a thermal design that improves the light output of cold cathode fluorescent lamps by permitting a desirable amount of lamp heating.

Yet still another aspect of the present invention is the use of the optical chassis as an illumination source for path and directional lighting.

DETAILED DESCRIPTION OF THE INVENTION

The present invention is generally directed towards an apparatus that improves the uniformity of illumination produced by one or more tube-shaped light sources across a planar illumination surface. The present invention comprises three main aspects. One aspect of the present invention is a novel optical coupler to convert the radial distribution of a tube-shaped lamps into an illumination that is substantially uniform across the plane of an adjacent display surface. A-second aspect of the present invention is an inventive optical chassis for use in emergency exit sign retrofit kits that has two spaced-apart optical couplers and which has mounting connectors for mounting the optical chassis in pre-existing exit signs. A third aspect of the present invention is the use of the optical coupler as an illumination source in other applications, such as new exit signs, new display signs, and directional lighting.

Figure 4:
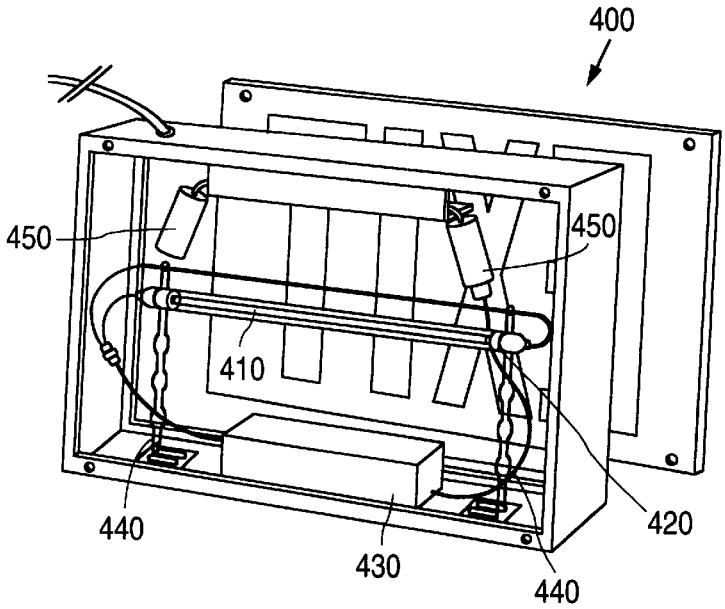
FIG. 4 shows a rear partial exploded view of a miniature fluorescent lamp retrofit kit which does not meet current UL retrofit kit standards.
Figure 5:
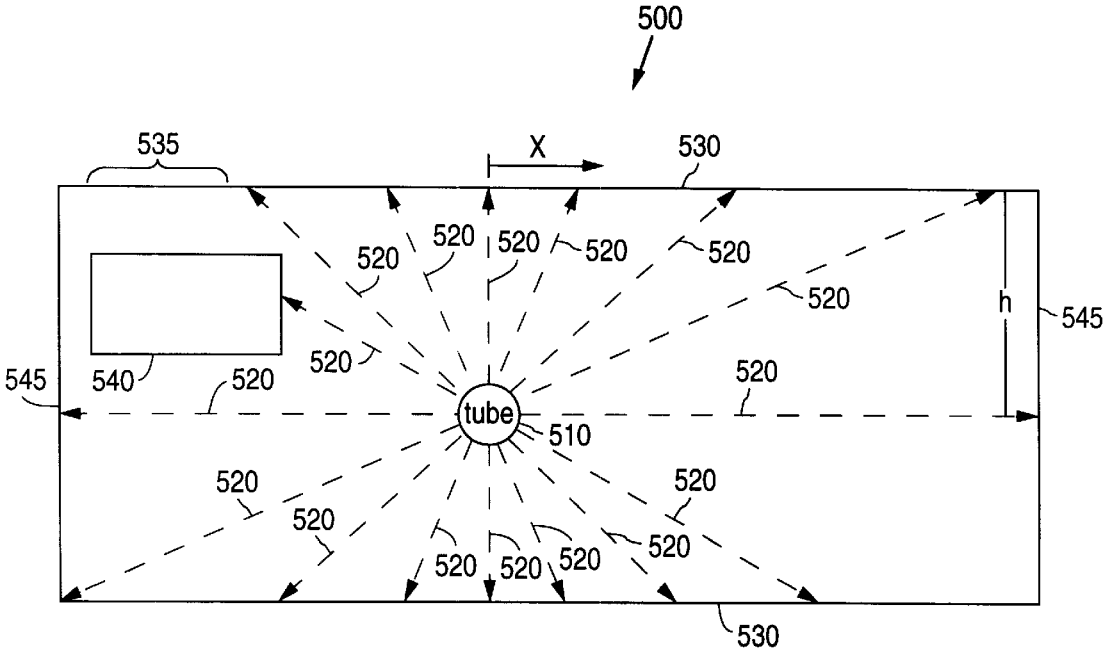
FIG. 5 is a side view showing the radial distribution of light from a prior art tube-shaped lamp onto planar display surfaces.
Figure 6:
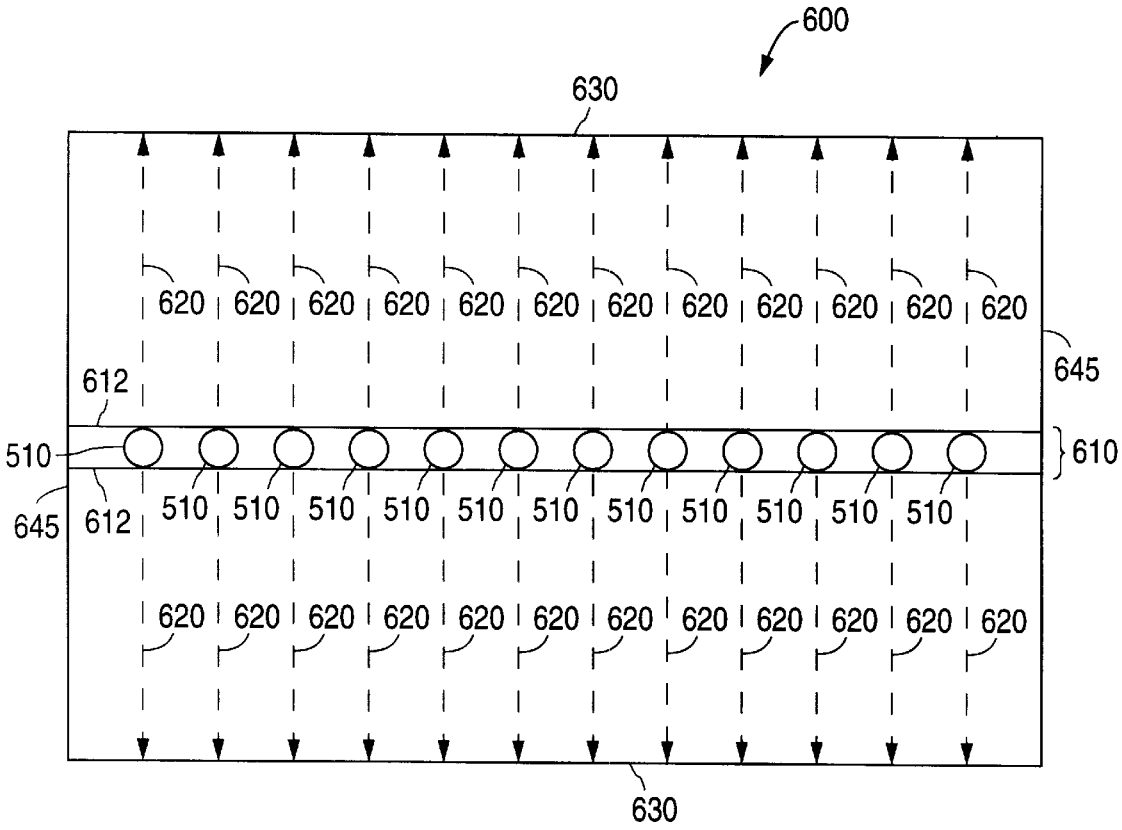
FIG. 6 is a side view showing how a large number of prior art tube-shaped lamps may be configured to emulate a planar light source for uniformly illuminating planar display surfaces.

The problem solved by the present invention is illustrated in FIGS. 4–6. FIG. 4 shows a rear partially-exploded view of a miniature cold-cathode fluorescent lamp (CCFL) emergency exit sign retrofit kit that was previously developed by the inventor of the present application, elements of which are disclosed in U.S. patent Ser. No. 08/630,361, which is the parent application of the present continuation-in-part application. A miniature cold-cathode fluorescent lamp 410 is mounted in a clear cylindrical tube 420. Miniature cold-cathode fluorescent lamps are low power dissipation white-light lamps sometimes used to provide background illumination in laptop computers. A variety of models of miniature cold-cathode fluorescent lamps can be obtained from Stanley Electric Co., Ltd, Nakemeguro, Meguro-ku, Japan. Miniature cold cathode lamps require a substantial AC voltage, typically several hundred volts, in order to achieve optimal light output. Cold cathode miniature lamps typically have an optimum power output at an operating temperature between twenty-five to thirty degrees Celsius. They come in a range of lengths and diameters, but typically have a diameter between about two millimeters to about six millimeters. Although the power rating of miniature cold-cathode lamps depends upon their length and diameter, a preferred size range of interest for exit signs is cold cathode lamps with a diameter of between 2.5 and 3.0 millimeters and a length between 180 to 240 millimeters. Cold cathode fluorescent lamps in this size range draw several watts of power depending the operating current and operating voltage.

While cold cathode fluorescent lamps are a preferred lamp 410, any miniature tube-shaped lamp with a comparable power dissipation may be used instead of cold-cathode fluorescent lamps. These include hot-cathode and semi-hot cathode miniature lamps with a diameter less than about 6 mm and a high voltage power supply ballast to improve their power conversion efficiency.

The cylindrical tube 420 provides mechanical protection to lamp 410 during the retrofit process, which is essential because of the fragility of miniature lamp 410. A high-frequency ballast 430 drives the lamp 410. Support clamps 440 are used to support the fluorescent lamp 410. The ballast 430 is electrically coupled to one set of wires feeding one of the original sockets 450 of exit sign 400.

Unfortunately, lamp 410 mounted in exit sign 400 as shown in FIG. 4 is not capable of satisfying the UL 924 illumination intensity and uniformity ratio (UR) requirements, which were issued subsequent to the filing date of U.S. patent Ser. No. 08/630,361. Investigations by the inventor indicate that even adding an additional second lamp 410 mounted in a cylindrical tube 420 (not shown in FIG. 4) does not satisfy the new UR standards for retrofit kits. It is believed that the sockets 450 and ballast 430 create deleterious shadowing that prevents a small number of lamps 410 in a retrofit kit from producing an acceptable UR and/or minimum brightness of extreme points of the letters.

The inventor has recognized that while an individual miniature CCFL is energy efficient, there is no simple way to arrange a small number of CCFLs to emulate the function of a planar light source with a low enough UR to satisfy the requirements of retrofit kits. The light energy from a miniature CCFL radiates radially in all directions from the sides of a cylindrical CCFL tube. This is shown in the side-view of FIG. 5, which shows two display surfaces 530 and side walls 540 of an exit sign 500. A lamp 510 produces a radially uniform distribution of light energy corresponding to uniform emission around a 360 degree arc. The luminous flux is typically defined as the rate of flow of light per unit of time (lumens). The illumination, also known as the illuminance, is the luminous flux per unit of surface area. Dashed lines 520 correspond to a radial distribution of luminous flux emitted from lamp 510. The illumination decreases at a distance, r, from tube 510 as 1/r, corresponding to an increased separation between dashed lines 520 with increasing radius. Referring to FIG. 5, for a lamp 510 disposed a distance h from a display surface 530, from the Pythagorean theorem the radius at a position x on the display surface is $r=\sqrt{(h^2+x^2)}$ so that the illuminance will decrease rapidly for x>h. The illuminance on a display surface 530 will tend to be highly non-uniform, as can be seen by the non-uniform separation of flux lines 520 on display surface 530.

There is an inherent mismatch between the radial distribution of light from tube 510 and the desire for a uniform illuminance on a planar display surface 530. Shadowing from ballast units or sockets only exacerbates the inherent difficulty of achieving an acceptable UR and minimum brightness of all 20 UL test points with a small number of tube-shaped lamps. For example, a ballast 540 may block flux 520 from a portion of display surface 535 proximate ballast 540. Additionally, some of the luminous flux 520 strikes side walls 545 instead of display surface 530, which tends to reduce the efficiency of illumination.

FIG. 6 shows a side view of a box-type emergency exit sign 600 with two display surfaces 630 and two side walls 645. As shown in FIG. 6, and as recognized by the present inventor, what is desired to achieve a low UR is a light source 610 that emulates the luminous flux characteristics of a planar light source. A planar light source 610 produces a flux distribution 620 that is uniform across planar display surfaces 630 adjacent to the plane of the light source. However, a conventional light source 610 that emulates the luminous flux characteristics of a planar light source would require numerous closely spaced lamps 510 and diffusing screen elements 612. In order for a series of spaced apart lamps 510 to emulate a true planar light source, the spacing between lamps 510 should preferably be a fraction of the separation distance between each lamp and the display surface 630. For example, to emulate a planar light source 20 cm high (about 8"), a series of ten lamps 510 spaced apart by one centimeter intervals could be used for a total of about twenty lamps 510. While such an arrangement of twenty lamps 510 would provide an improved UR compared to a single lamp 510, it would greatly increase the manufacturing costs and power consumption to a level comparable to two conventional incandescent bulbs. Consequently, the planar light source 610 shown in FIG. 6 is not a practical option for emergency exit sign retrofit kits.

Figure 7A:
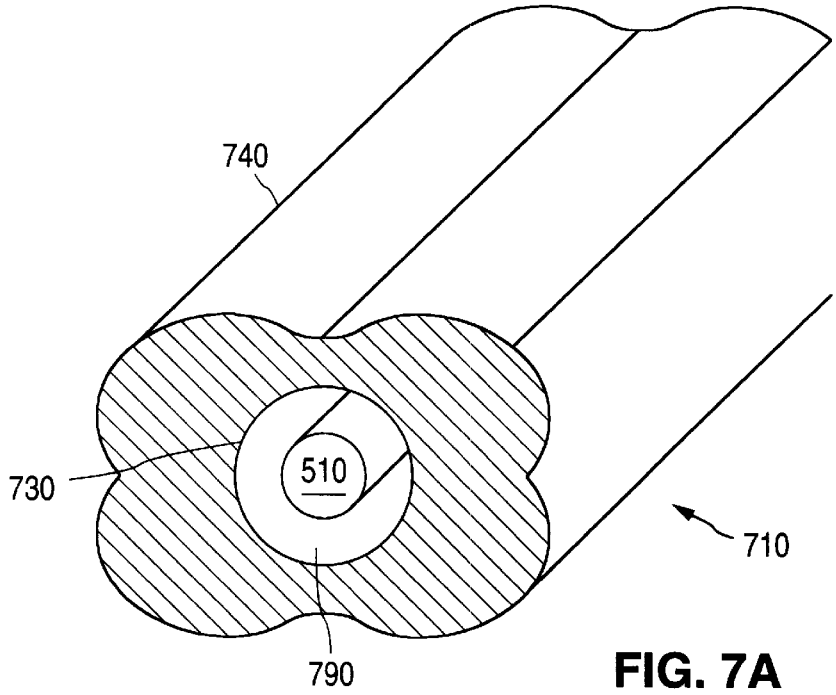
FIG. 7A is a perspective view showing a miniature lamp housed in a chamber formed in an inventive optical coupler.

The inventor has recognized that an optical coupler may be used to modify (bend) the flux trajectory produced by a cylindrical lamp to produce a uniform illumination across a planar surface region. A common element to all embodiments of the present invention is an optical coupler which adjusts the trajectory of luminous flux 520 from lamps 510 so that a small number of lamps 510 may be used to achieve a low UR on an illuminated display surface 530. An optical coupler 710 constructed according to the teachings of the present invention is shown in the perspective view of FIG. 7A. Optical coupler 710 is an optical element that transforms the radial flux distribution of a cylindrical light source into an illuminance at a display surface 530 more closely approximating that of a planar light source. Optical coupler 710 may be used an individual element for a variety of applications. However, the inventor has also developed an optical chassis that utilizes two optical couplers 710 and two lamps 510 as part of a retrofit kit that exceeds current UL standards in a kit that requires only two CCFL lamps 510.

Optical coupler 710 is preferably dimensioned to form an interior chamber 790 dimensioned to house a tube-shaped lamp 510. Additional resilient end-cap support units (shown in FIG. 18A) are preferably used to support lamp 510 in the center of chamber 790 and to provide an electrical power coupling through a passageway (not shown in FIG. 7A) in chamber 790. Experimental results indicate that supporting lamp 510 in the center of chamber 790 improves the light output compared to direct physical contact of lamp 510 with the interior surfaces of chamber 790. Additionally, supporting lamp 510 in the center of chamber 790 has the additional benefit of rendering lamp 510 less susceptible to breakage which may otherwise occur as a result of shock and vibration. While resilient end-cap supports are a preferred means to suspend the lamp 510 in the center of chamber 790, other suspension means may be also used. Generally, any mechanical coupler or mechanical coupling arrangement which suspends the lamp in the center of the chamber (i.e., no direct contact with chamber walls) and which permits flexure of the lamp in response to vibration or shock may be used. This would include a resilient suspension coupler, such as a spacer ring disposed in a portion of chamber 790. Additionally, since a cold cathode miniature fluorescent lamp 510 is extremely light, it may also be suspended from its electrical contact wires (not shown in FIG. 7A) in a manner similar to that described in the parent application of the present application. Generally, the preferred resilient end-caps of FIG. 18A may be replaced with any resilient suspension means that permits the lamp 510 to normally reside in the center region of the chamber 790 while permitting lamp 510 to flex inside chamber 790 in response to vibration, such as that which may occur during shipment and/or installation.

Optical coupler 710 is preferably fabricated as a two piece unit that is joined around lamp 510 to provide both a protective housing and an optical coupling function. Chamber 790 is formed between outer surface 740 and inner surface 730 of optical coupler 710.

Optical coupler 710 may comprise a plurality of different optical layers which performs the function of converting a radial distribution of light into a substantially more uniform distribution on a planar surface adjacent to the optical coupler. Those of ordinary skill in the art are familiar with optical structures that alter the trajectory of light rays. As is well-known in the field of optics, the trajectory of light rays may be altered using the principals of refraction and reflection.

In a preferred embodiment, optical coupler 710 is fabricated from a piece of molded optical plastic with a uniform refractive index wherein the outer contour of an outer surface 740 of optical coupler 710 is shaped to refract light to achieve a more uniform distribution of flux on a display surface 530. However, more generally inner surface 730 could also be shaped to alter the trajectory of light rays. Additionally, optical coupler 710 could comprise a plurality of layers with different refractive indices and/or incorporate reflective layers.

Figure 7B:
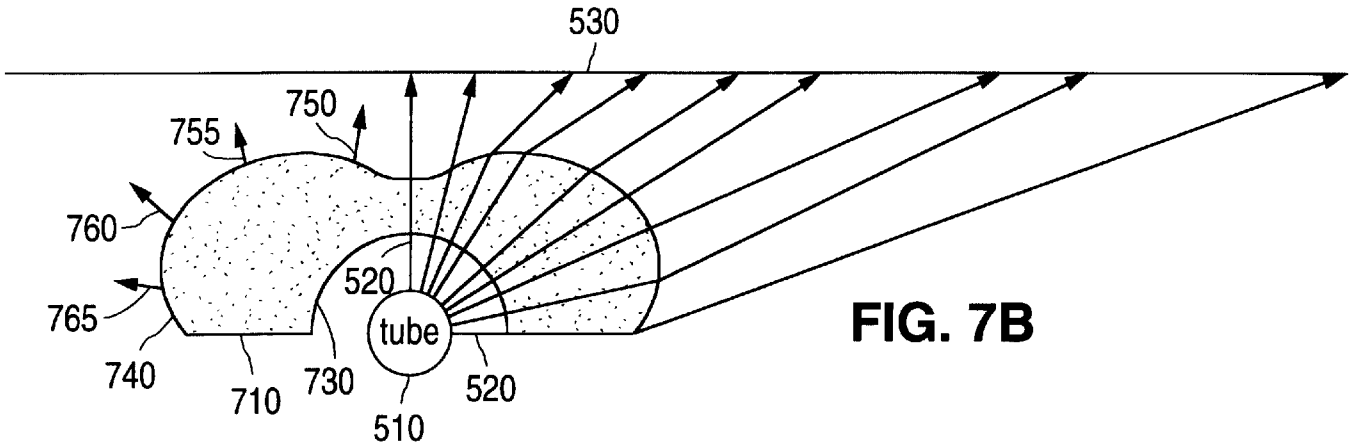
FIG. 7B is a side view of a portion of the optical coupler of FIG. 7A illustrating how light rays from a miniature lamp are re-directed to achieve a more uniform illumination of a planar display surface.

FIG. 7B is a side view showing the light coupling characteristics of a preferred optical coupler 710. For the purposes of illustration, optical coupler 710 is shown as partially enclosing lamp 510. More generally, however, two optical couplers 710 are preferably used to completely enclose a lamp 510 in the manner of FIG. 7A. For the purposes of illustration, light rays from one-quarter of the surface of lamp 510 are shown traversing optical coupler 710.

In a preferred embodiment, optical coupler 710 is comprised of an optical material with a refractive index, n, greater than 1. According to Snell's law, the angle at which light is transmitted from a first region to a second region is given by the relationship: $n_1 \sin\theta_1 = n_2 \sin\theta_2$, where $n_1$ is the refractive index in a first region, $\theta_1$ is the angle of incidence of a light ray relative to the surface normal as it enters the interface of the second region, $n_2$ is the refractive index in the second region, and $\theta_2$ is the exit angle of the ray in the second region relative to the surface normal. For a transition from a high refractive index to a low refractive index, the exit angle of a ray relative to the surface normal increases relative to the entrance angle.

Referring to FIG. 7B, rays 520 from a ninety-degree arc surrounding tube 510 are shown for illustrative purposes. Rays 520 impinge upon a first curved cylindrical surface 730 of optical coupler 710 at a normal angle ($\theta_1 = \theta_2 = 0$). Consequently, rays 520 travel in a straight line until they reach outer curved surface 740 of optical coupler 710. The angle at which the rays are refracted will depend upon the surface normal along each portion of outer curved surface 740. Outer curved surface 740 is preferably shaped so that the refracted rays illuminate display surface 530 with an illuminance approximating that of a planar illumination source.

The required curvature of outer curved surface 740 can be optimized using ray tracing techniques to calculate the illuminance at display surface 530 for a particular geometry as the curvature of outer surface 740 is adjusted. Referring to the left-hand side of outer curved surface 740, surface normal vectors 750, 755, 760, 765 are shown. The vector direction of surface normal vectors 750, 755, 760, 765 varies along the surface. The direction at which a ray impinging outer surface 740 is refracted can be calculated using Snell's law. The outer surface 740 may be shaped to adjust, as required, the vector direction of the surface normal 750, 755, 760, 765 at different regions along surface 740 to achieve a more uniform distribution of luminous flux 520 on display surface 530.

As used in this application, a substantial improvement in the uniformity of the illuminance on a display surface corresponds to at least a 30% improvement in uniformity of the illuminance over a display surface compared to bare lamps alone. Empirical measurements of the affect of optical coupler 710 on illumination uniformity across display areas comparable to those of emergency exit signs indicates that at least a 30% improvement in the uniformity of the illuminance may be achieved compared to bare lamps alone. For example, in one case the addition of the optical couplers resulted in a decrease in peak luminence from 5900 to 2900 lumens, corresponding to at least a 50% improvement in uniformity over the display surface compared to bare lamps positioned in similar locations.

Figure 8:
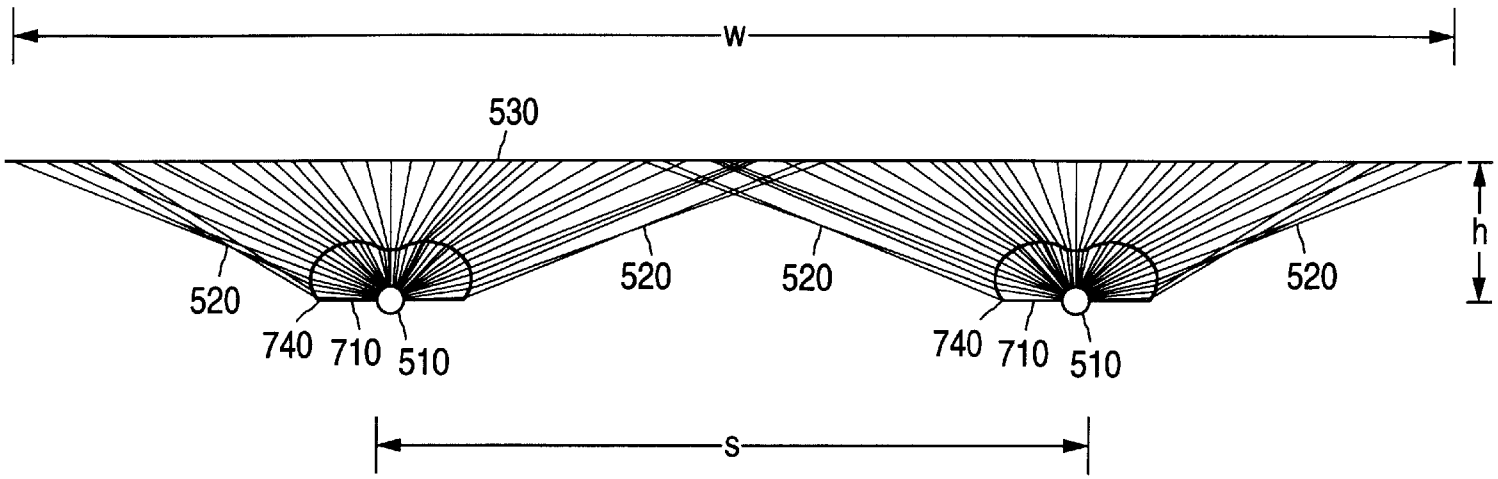
FIG. 8 is a side view showing how light rays from two spaced apart miniature lamps are re-directed by two optical couplers onto a display surface.

While optical coupler 710 greatly improves the UR of a single lamp 510, two spaced-apart lamps 510 are preferred to achieve a low UR for emergency exit sign retrofit kits. FIG. 8 shows a side-view of a ray-tracing calculation showing rays 520 refracted from two spaced-apart lamps 510 each of which has its own optical couplers 710. Lamps 510 are spaced apart by a distance, S, from each other and by a distance, h, from the display surface 530. As can be seen in FIG. 8, illuminance on a portion, W, of display surface 530 has a low UR. Thus, the optical couplers of the present invention permit a small number of tube-shaped lamps 510 to emulate the function of a planar light source, which permits a small number of energy-efficient cold cathode fluorescent lamps (or other low power dissipation lamps) to be used to illuminate a display surface. While the optical couplers of the present invention are designed to permit a small number of cold cathode fluorescent lamps to satisfy UL standards for exit signs, the optical couplers of the present invention provide a benefit when used as an illumination source in other applications, such as advertisement display signs and household number signs. For example, improvements in the illumination uniformity of a household number sign may improve the distance from which the numbers may be clearly read. Also, while it is desirable in many applications that the illumination source provide a white light, the illumination source could be used to provide a colored light source by using lamps 510 with a colored output. Among the well-known methods to convert a white light source into a colored output (e.g., red, green), are: 1) the use of colored glass on the lamps; 2) different phosphor/gas combinations in the lamps; and 3) modification of a diffuser lens to produce a colored output.

EXAMPLE I: EMERGENCY EXIT SIGN RETROFIT KIT

Emergency exit sign retrofit kits pose special problems because of the problem of shadowing by the ballast required for the miniature lamps. Consequently, the inventors have developed a chassis configuration that places a ballast unit in a non-shadowing position.

Figure 9:
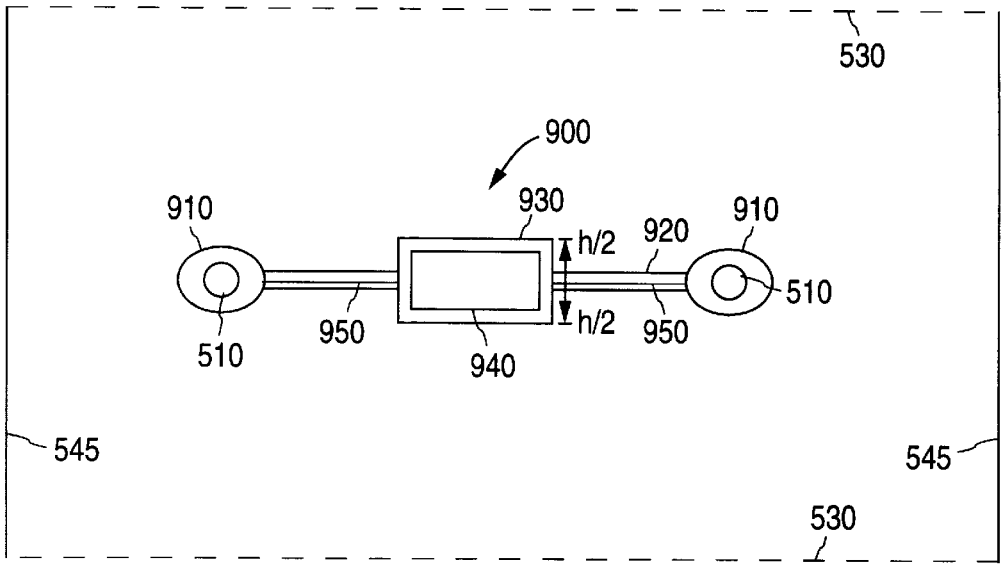
FIG. 9 shows a side view of an optical chassis of the present invention containing two optical couplers.

FIG. 9 shows a side view of a generalized optical chassis 900 of the present invention for use in emergency exit sign retrofit kits. Optical chassis 900 includes two spaced-apart optical couplers 910. The optical couplers 910 are mechanically coupled to a frame 920. A ballast compartment 930 containing a voltage converter 940 is disposed on frame 920 between the optical couplers 910 so that the ballast compartment 950 does not obstruct the light from lamps 510 disposed in optical couplers 910. Voltage converter 940 receives a local voltage source (e.g., line AC voltage or a local DC voltage source) and converts it into an output voltage selected to drive lamps 510. Electrical connections 950 disposed on frame 920 couple power from voltage converter 940 to lamps 510. A further benefit of the relative placement of optical couplers 910 and ballast compartment 930 is that the length of electrical connections 950 from voltage converter 940 to lamps 510 is reduced compared to the retrofit kit 400 of FIG. 4. This reduces resistive power losses, resulting in improved efficiency. Additionally, the length of the electrical connections 950 to each lamp is preferably selected to be identical, which results in the balanced operation of each lamp (e.g., equal inductance paths), which tends to reduce parasitic losses.

The optical chassis 900 is preferably formed as a two-piece molded plastic shell having chambers into which lamps 510, electrical connectors 920 and voltage converter 930 are disposed. The height, h, of ballast compartment 930 is preferably minimized to further reduce potential shadowing. Acrylic is a preferred plastic, although a variety of other optical plastics and polymer-based materials may be used as well. Other non-polymer based optical materials could also be used. For example, common glass may be used to fabricate optical coupler 710. However, glass is less desirable than optical plastic because of the brittleness and fragility of glass.

Figure 10:
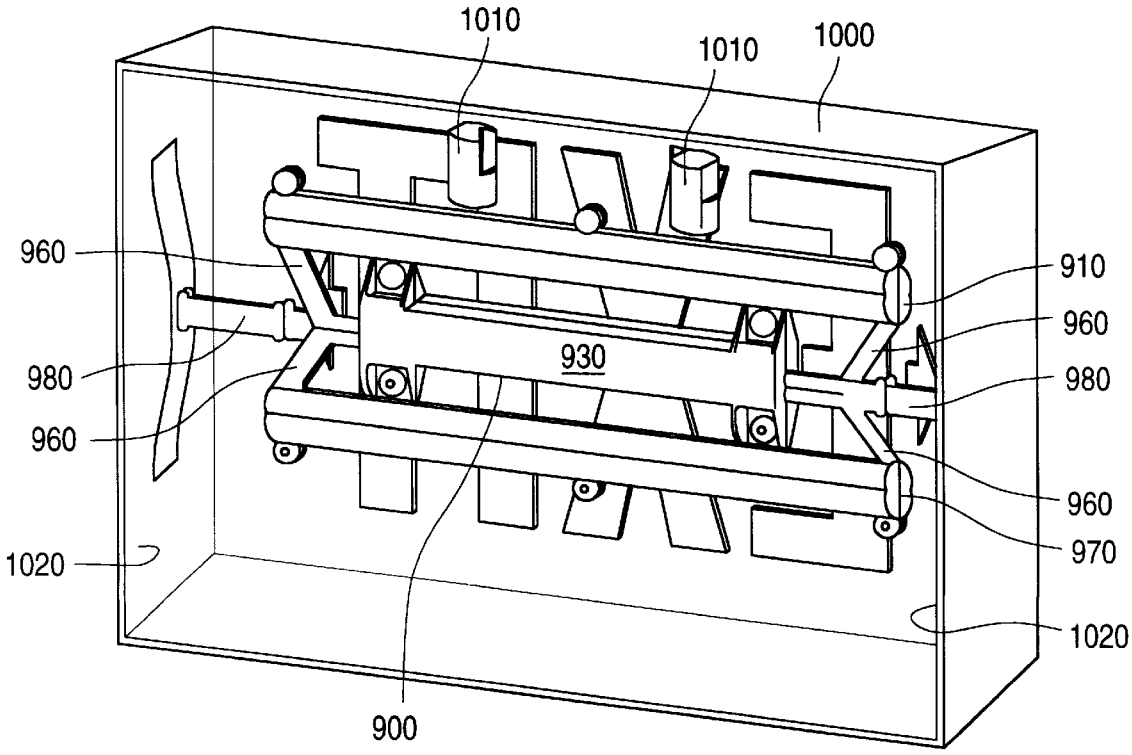
FIG. 10 is a rear perspective view of a first embodiment of an installed retrofit kit.

FIG. 10 shows a perspective view of a preferred embodiment of an installed retrofit kit of the present invention. Optical chassis 900 is mounted into a pre-existing box-type exit sign 1000. A panel (not shown in FIG. 10) is removed. Pre-existing incandescent bulbs (not shown in FIG. 10) are removed from sockets 1010. Adjustable mechanical connectors 980 are used to lock optical chassis to sidewalls 1020 of emergency exit sign 1000. As can be seen in FIG. 10, optical chassis 900 also preferably contains connector regions 960 for enclosing electrical connections 950 between ballast 930 and tubes 510 disposed in optical couplers 910.

Figure 11:
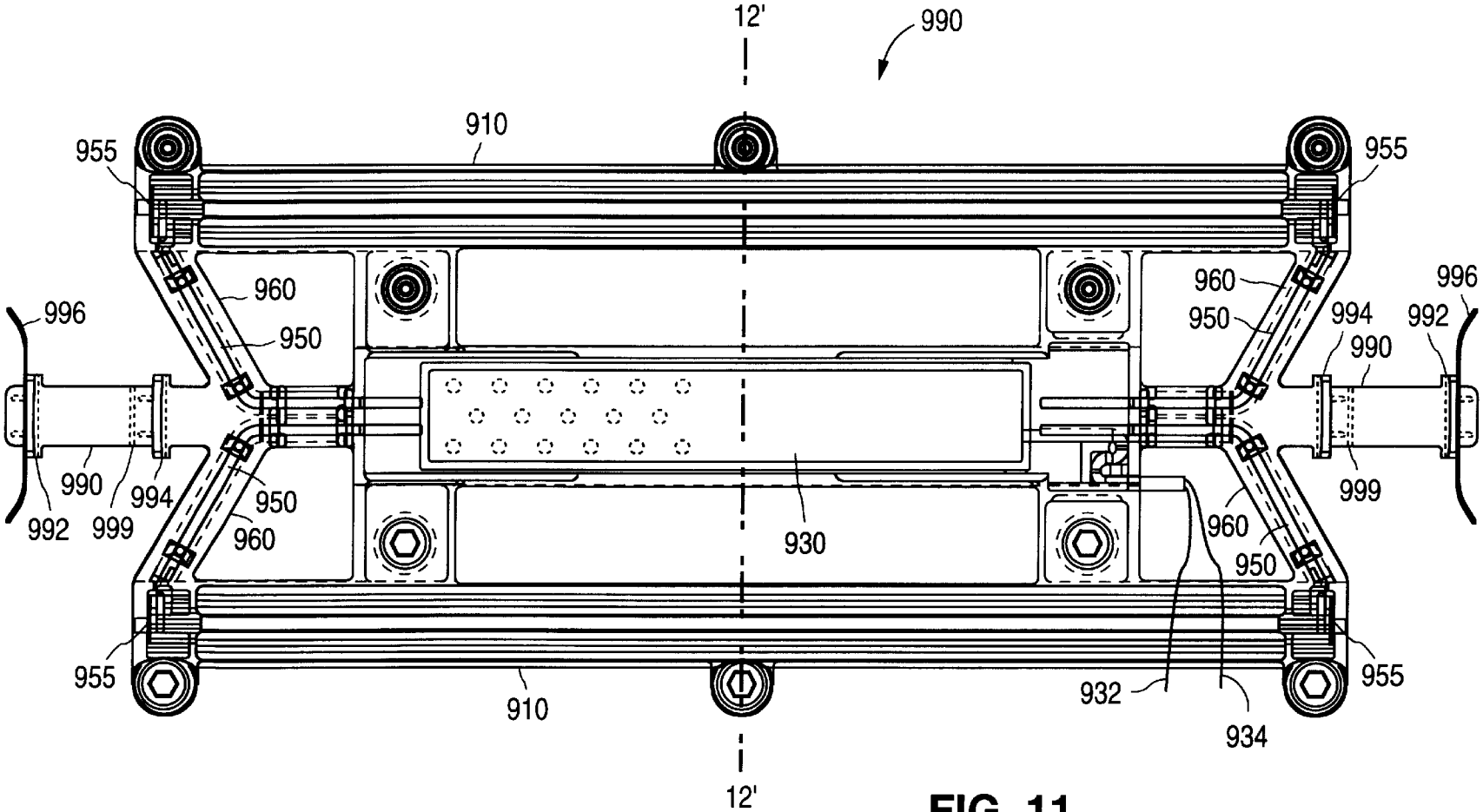
FIG. 11 is top view of the retrofit kit of FIG. 10 prior to installation.

FIG. 11 is a front view of a preferred embodiment of optical chassis 900 in an un-installed state. Electrical connectors 950 disposed in connector regions 960 extend to end-cap regions 955 of optical couplers 910. A passageway (not shown in FIG. 11) permits wires, end-caps, or other common electrical connections to the end-regions of lamps 510 to be electrically coupled to electrical connectors 950. Extensions 990 are coupled to optical chassis 900. Extensions 990 have rim surfaces 992, 994 spaced apart along its length. Spring clips 996, 998 have slots dimensioned so that spring clips 996 may seat against a rim surface 992, 994. Extension 990 may be cut proximate to rim surface 994 to adjust the length of the mechanical connection. For example, cut line 999 indicates a cutting surface that will reduce the length of extension 990. Preferably a variety of spring clips sizes are provided with the retrofit kit to provide further optimization of the mechanical fit of the mechanical connectors 980 for different size box-type exit signs. Preferably spring clips 996 have an anti-slip contact surface, such as plastic feet.

Referring to both FIGS. 10 and 11, to install the retrofit kit, a display surface of an existing exit sign is first removed. The old incandescent, fluorescent, or LED light sources are removed. The user determines the appropriate length for proper lateral fit. For the case of a box-type exit sign with a short width, portions of plastic extension 990 are cut off. Although there are a variety of box-exit sign styles and sizes, most can be accommodated with two choices for the length of the plastic extension 990. The unit is installed into place with the spring clips 996 pressing against side walls 1020 of the box exit sign 1000.

It is desirable that a retrofit kit may be installed in a matter of a few minutes. While making electrical connections to pre-existing sockets is possible, there are five different socket designs used in pre-existing exit signs. Consequently, there is no universal plug available to fit into the sockets of all of the different models of pre-existing box exit signs. It is therefore desirable to directly couple wires 932, 934 to insulated power lines using a solderless connector. Connection between wires 932, 934 and electrical lines is preferably made using a Tap-In™ connector, available in retail quantities from Radio Shack, a division of Tandy Corp, Fort Worth Tex. 76102. Tap-In™ connectors are manufactured by 3M of Minneapolis, Minn., and are sold in large volume quantities as the T-Tap™ connector. Tap-In™ connectors permit an electrical connection to made by folding the body of a Tap-In™ connector around an insulated power line to form a female socket. Corresponding male connectors connected to wires 932, 934 permit a solderless connection.

Figure 12:
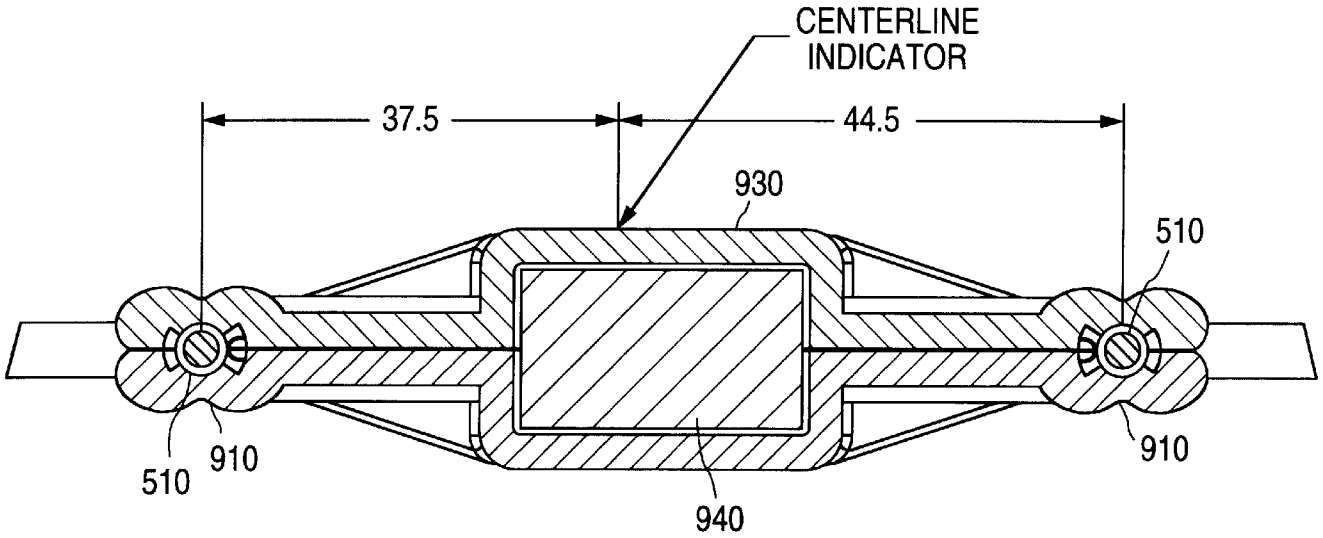
FIG. 12 is a cross-sectional view of the retrofit kit of FIG. 11 along line 12—12.

The illumination and UR are sensitive to the spacing between lamps 510 and the placement of the chassis 900 relative to the centerline of the exit sign. FIG. 12 shows a cross-section of the optical chassis 900 of FIG. 11 along line 12'—12'. Lamps 510 are preferably spaced apart by 82 millimeters. A centerline indicator indicates a preferred center, relative to the center stroke of the "E" of an exit sign, relative to the optical chassis 900.

Figure 13:
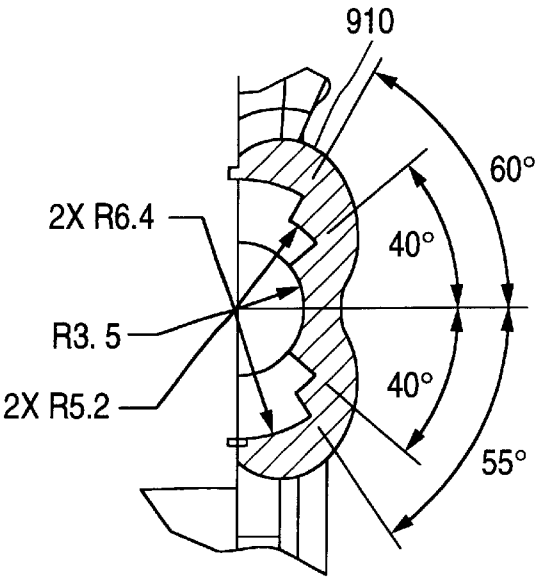
FIG. 13 is a detailed side view of one-half of the optical coupler of FIG. 11, showing how the inner surface comprises regions with three different radii to improve manufacturability.

FIG. 13 shows a detailed scaled side view of a portion of optical coupler 910 of FIG. 12. It can be seen that the inner surface 1305 of optical coupler 910 comprises five constant radii segments. Luminous flux 520 from lamp 510 impinges normally on all of the inner surfaces. Consequently, the multiple-radii inner surface 1305 does not affect the trajectory of light rays traversing optical coupler 910. As in the embodiment of FIG. 7B, the refractive index and shape of the outer surface of optical coupler 910 is believed to control the manner in which light rays refract. However, the optical coupler design of FIG. 13 facilitates an injection molding process because the optical coupler 910 has approximately uniform thickness walls forming the chamber housing lamp 510.

Figure 14:
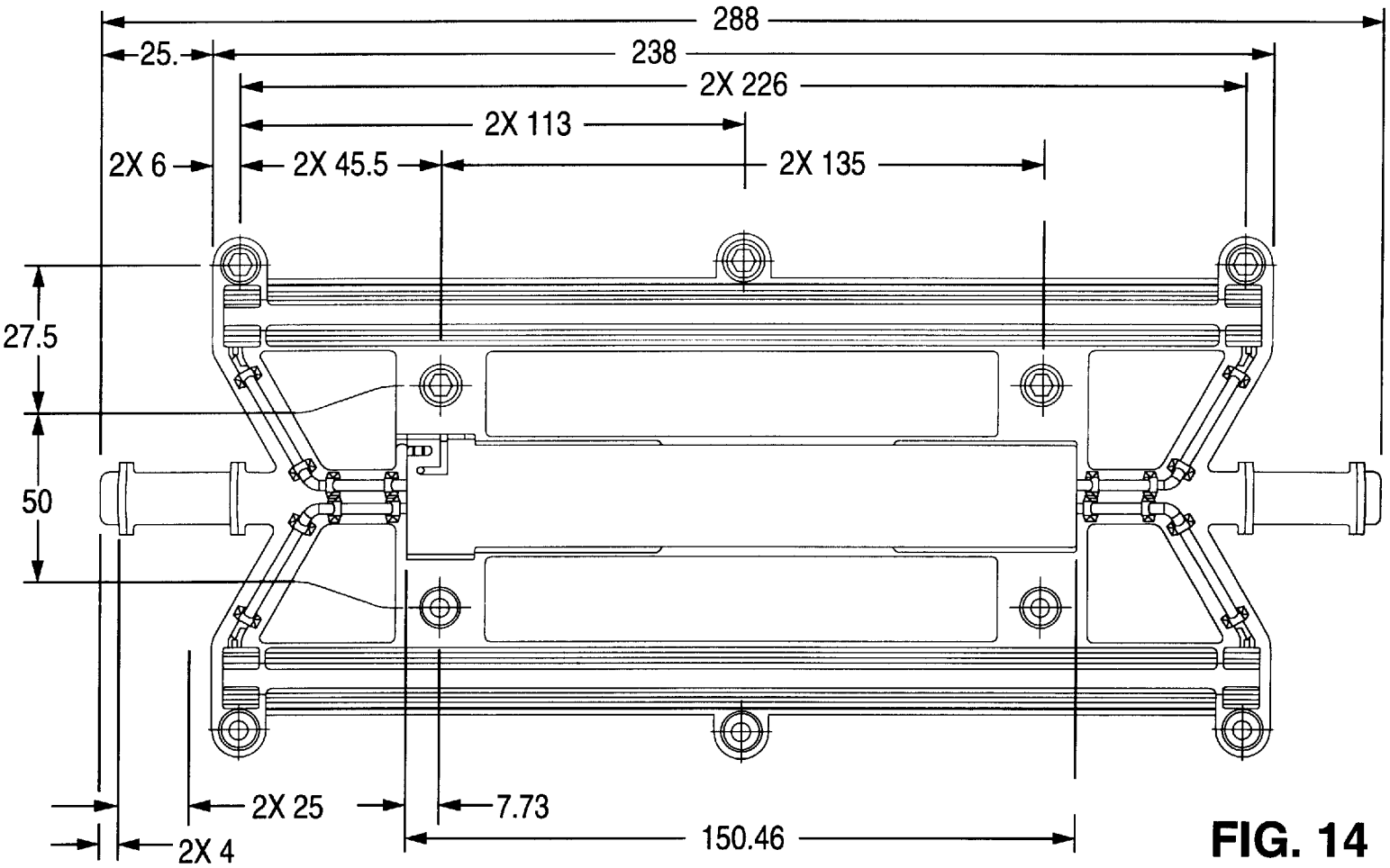
FIG. 14 shows a top view of the retrofit kit of FIG. 10 with preferred dimensions.

FIG. 14 is a front view of the embodiment of optical chassis 900 of FIG. 12 showing preferred dimensions, in millimeters, for a universal emergency exit sign retrofit kit. However, it will be recognized that variations on these dimensions are possible for applications of optical chassis 900 in new exit signs or for other applications.

Figure 15:
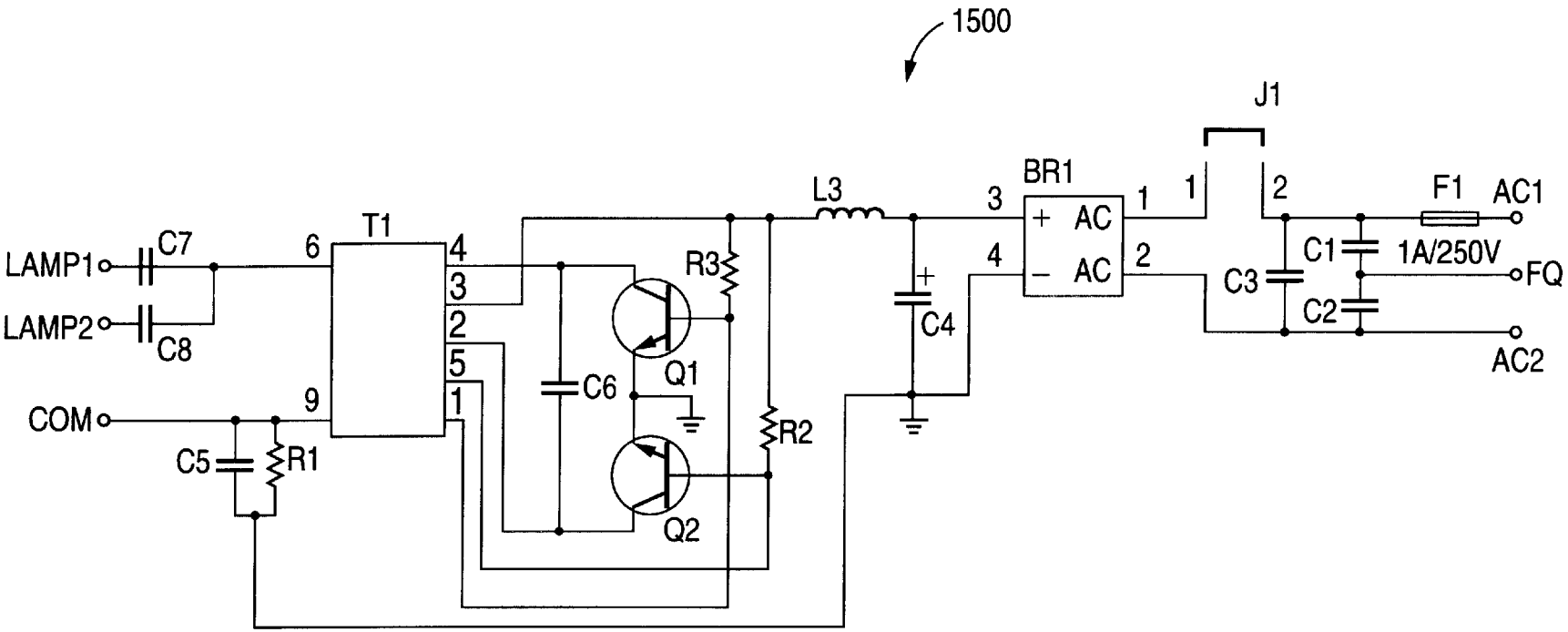
FIG. 15 shows a preferred AC—AC power supply circuit for use as a voltage converter in the retrofit kit.

Generally, any compact voltage converter 940 may be used that is consistent with converting a local source of power, such as AC line voltage, into the voltage required by lamp 510. FIG. 15 shows a circuit schematic of a preferred AC—AC voltage converter 940, although other power converters could be used as well. Voltage converter 1500 comprises a switched power supply, what is commonly known as a switch-mode step-up voltage converter. In some locations, local supplies of DC voltage, such as 50 VDC are available. For this situation, a DC-AC voltage converter would be required.

Figure 16:
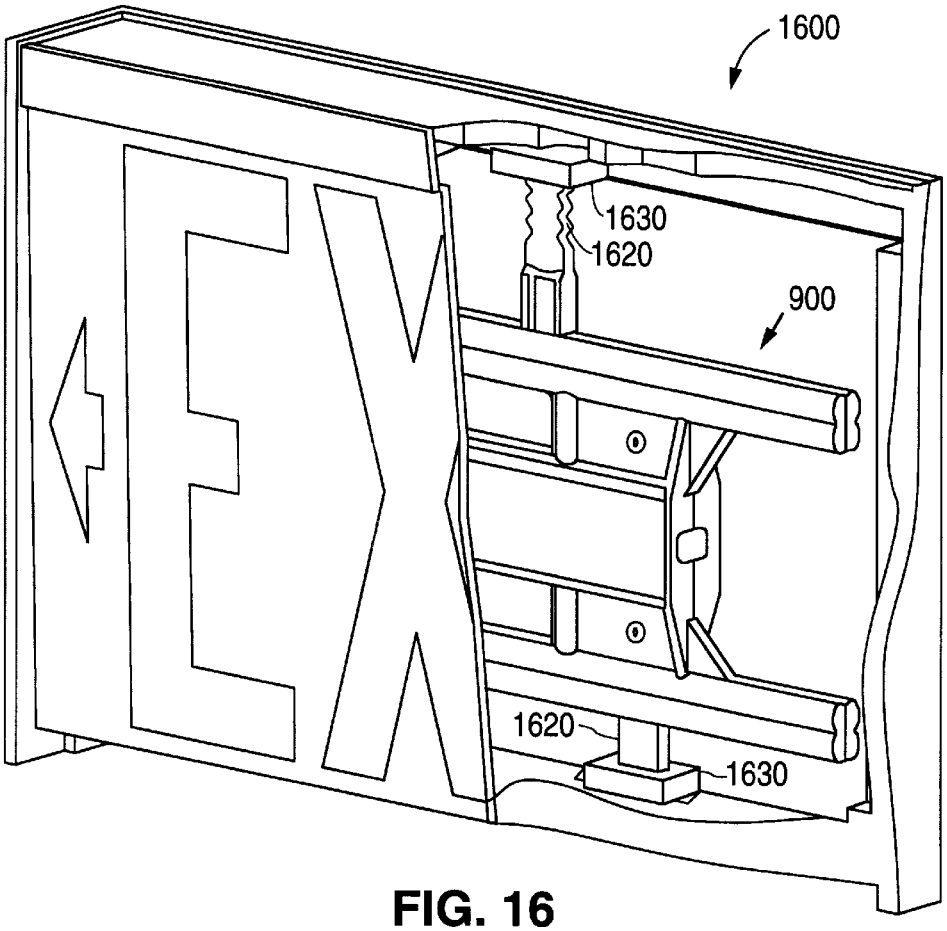
FIG. 16 shows a perspective view of an embodiment of the retrofit kit with a friction leg mounting system.
Figure 17:
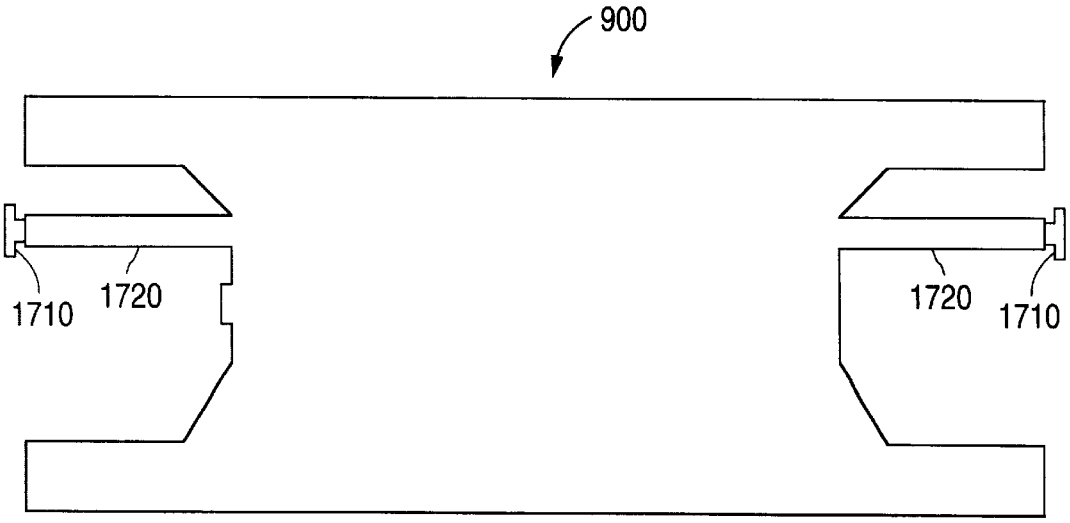
FIG. 17 shows a top view of an embodiment of the retrofit kit with a spring-plunger mounting system.

While a mounting connector 980 comprising extensions 990 and spring clips 996 is preferred, other mounting connectors may also be used. FIG. 16 shows a first alternate mounting structure for use with the optical chassis 900. Plastic mounting legs 1620 with snap-on mounting feet 1630 are used to lock the optical chassis 900 into place in exit sign 1600. The length of the mounting legs 1620 is selected at the site and then the legs 1620 are shortened by cutting the mounting legs 1620. Undulations on the sides of the mounting legs 1620 are preferably included to facilitate cutting the legs and/or fitting the leg onto a snap-on mounting feet, 1630. FIG. 17 shows a second alternate mounting structure. An optical chassis 900 (shown in outline only) has plungers 1710 coupled to springs (not shown in FIG. 17) inside a plunger case 1720. Plungers 1710 form a spring compression mount to the walls of a box-type exit sign.

Figure 18A:
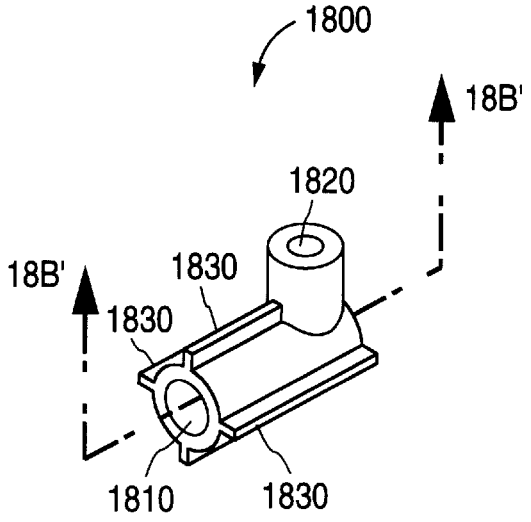
FIG. 18A shows a perspective view of a preferred silicone end cap used to cushion, support, and facilitate electrical connections to miniature lamps disposed in the chambers of the inventive optical couplers.
Figure 18B:
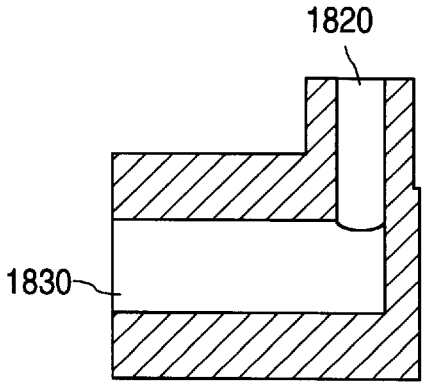
FIG. 18B shows a cross-sectional view of a silicone end-cap of FIG. 18A along the line 18B—18B.

A preferred silicone end-cap to hold the ends of lamps 510 within optical couplers 910 while permitting an electrical connection to be made to lamps 510 is shown in FIG. 18A. A silicone end cap 1800 has a first cavity 1810 dimensioned to form a receptacle for one end of a tube-shaped lamp 510. A passageway 1820 permits electrical connections to be fed through end cap 1800. Spacer ribs 1830 are used to maintain lamp 510 disposed within the center of optical coupler 910. It is believed that end caps 1800 protect lamps 510 from vibration and shock. Additionally, end caps 1800 facilitate the accurate alignment of lamps 510 within optical couplers 910, which may improve the efficiency of the optical couplers compared to the situation that the lamps 510 are tilted along their axis with respect to the axis of the optical coupler 910. FIG. 18B shows a cross sectional view of end cap 1800 along line 18B—18B of FIG. 18A.

The preferred embodiment of an emergency exit sign retrofit kit has a UR of 5 and a light output of 70 FL. The UR of the present invention is a factor of four better than the current UL standard of 20:1 while the light output is up to a factor of 11 better than the current UL standard of 6 FL. Moreover, the cold-cathode fluorescent tubes result in an energy savings of 85%.

EXAMPLE II: NEW ILLUMINATED DISPLAY SIGNS AND DIRECTIONAL LIGHTING

While the present invention is particularly addressed to the problem of retrofitting box-type emergency exit signs with two display surfaces, the optical coupler and optical chassis of the present invention may also be used for other applications as well. These applications include: 1) the illumination of single display surfaces, such as household number signs; 2) new emergency exit signs; and 3) other directional lighting applications.

Figure 19A:
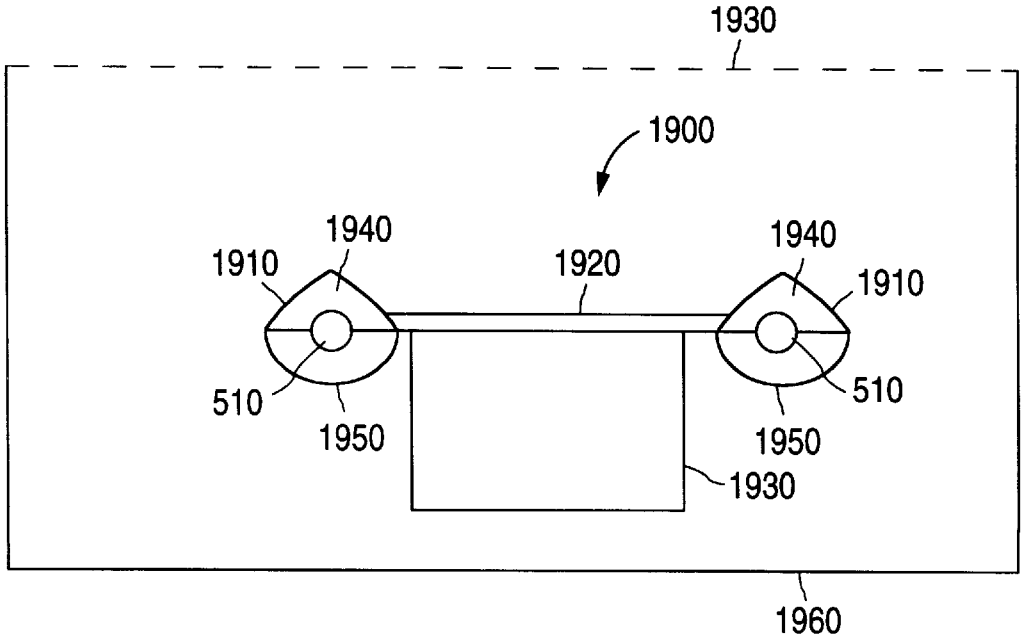
FIG. 19A shows a side view of an embodiment of an illumination source for illuminating a single-sided sign.

FIG. 19A shows a modification of the present invention for illumination of a single display surface 1930. The optical chassis 1900 is preferably modified to increase the illumination of the single display surface 1930. The ballast compartment 1930 may be disposed underneath the optical couplers 1910 under frame 1920. Moreover, optical couplers 1910 may comprise both reflector sections 1950 and beam-forming sections 1940. The reflector sections 1950 may, for example, reflect light from an 180 degree arc around the lamp 510 (not shown in FIG. 19A) and be re-directed so that substantially all of the light emitted from the enclosed is coupled by beam-forming section 1940 onto the single display surface 1930.

The embodiment of FIG. 19A is believed to have other applications as an energy efficient illumination source.

These include, but are not limited to, a variety of path-finding lights and directional arrows used to distinguish a path or obstacles. Conventional incandescent bulbs used in path-finding lights have a significant operating cost in terms of energy consumption and the cost and labor to replace the bulbs. A more uniform illumination source is also desirable in these applications as well, i.e., it is desirable that a small number of energy efficient tube-shaped lamps emulate the optical characteristics of a planar light source. It is also desirable to have an optical chassis with adjustable mechanical couplers that may be quickly installed into pre-existing light modules or inserted into new modules.

Figure 19B:
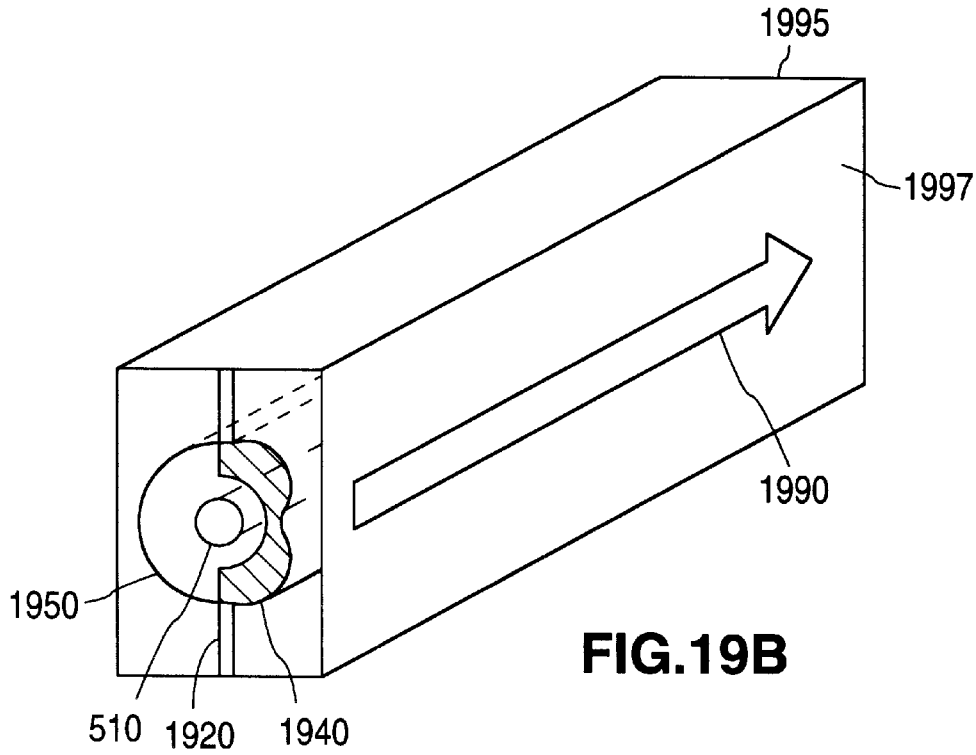
FIG. 19B shows a perspective view of an application of the illumination source of FIG. 19A in a directional arrow sign.

FIG. 19B shows an embodiment of a directional arrow lighting embodiment based upon the optical coupler design of FIG. 19A. A box-style module 1995 comprises a front surface 1997 with a directional arrow 1990. For the purposes of illustrations, an optical chassis with one lamp is shown, although an optical chassis with two lamps could also be used as well. Frame 1920 holds an optical coupler 1910 comprised of a reflector section 1950 and a beam forming section 1940 whose optical characteristics are selected to more uniformly illuminate arrow 1990.

Figure 19C:
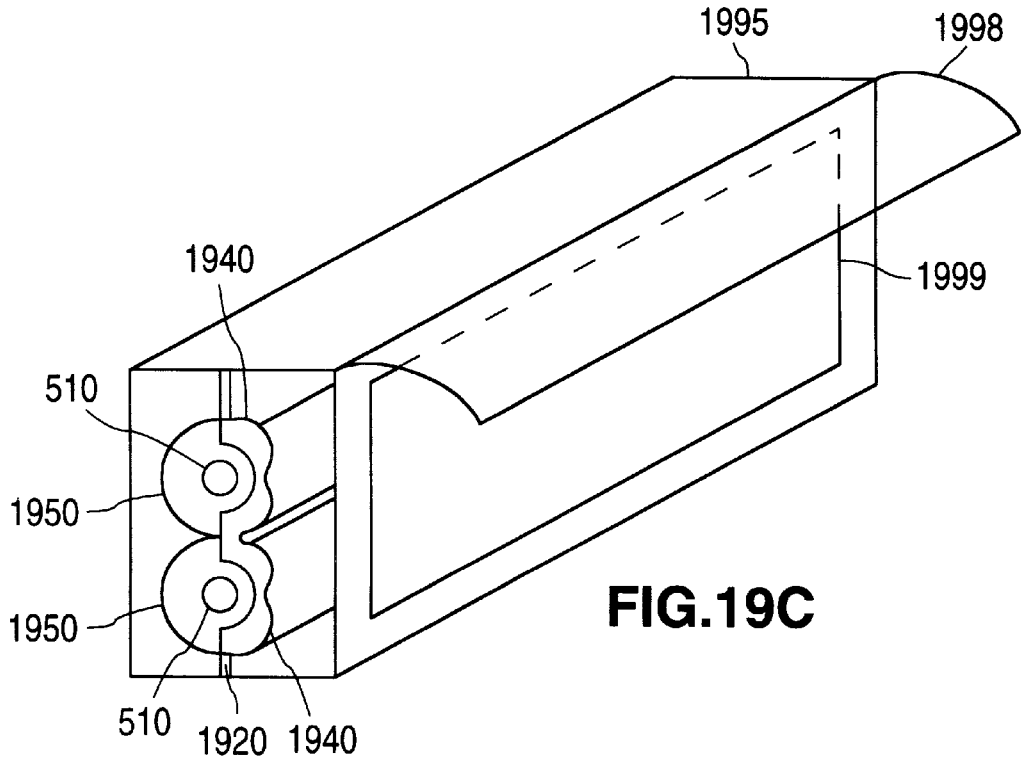
FIG. 19C shows a perspective view of an application of the illumination source of FIG. 19A in a path-finding light.

FIG. 19C shows an embodiment of a path light based upon the optical coupler design of FIG. 19A. A box-style module 1995 includes a translucent or transparent window surface 1999. Window surface 1999 may also comprise an optical diffusing material so that window 1999 performs an optical diffusing function. A louvre 1998 is preferably disposed on an upper surface of the module to direct light downwards for ground-lighting applications. The other elements are the same as those shown in FIG. 19A. It should be noted that for a ground lighting applications that the beam-forming elements 1940 may be shaped to direct light downwards (i.e., at a downward tilt angle towards the ground relative to the surface normal of window 1999).

It should also be noted that any of the mounting connector and optical chassis configurations discussed in this application may be used as new or retrofit illumination sources for directional arrow or path light illumination sources. However, the use of integral reflector elements 1950, as shown in FIGS. 19B and 19C, is preferred because it improves the coupling of light to a single illuminated surface 1990 or window 1999. It should also be noted that for the case where two lamps are required, the spacing between lamps will be optimized for a particular application. It will also be recognized that the length of the lamps will be adjusted for a particular illumination application (e.g., to have about the same length as directional arrow 1990 in the embodiment of FIG. 19B).

Figure 20:
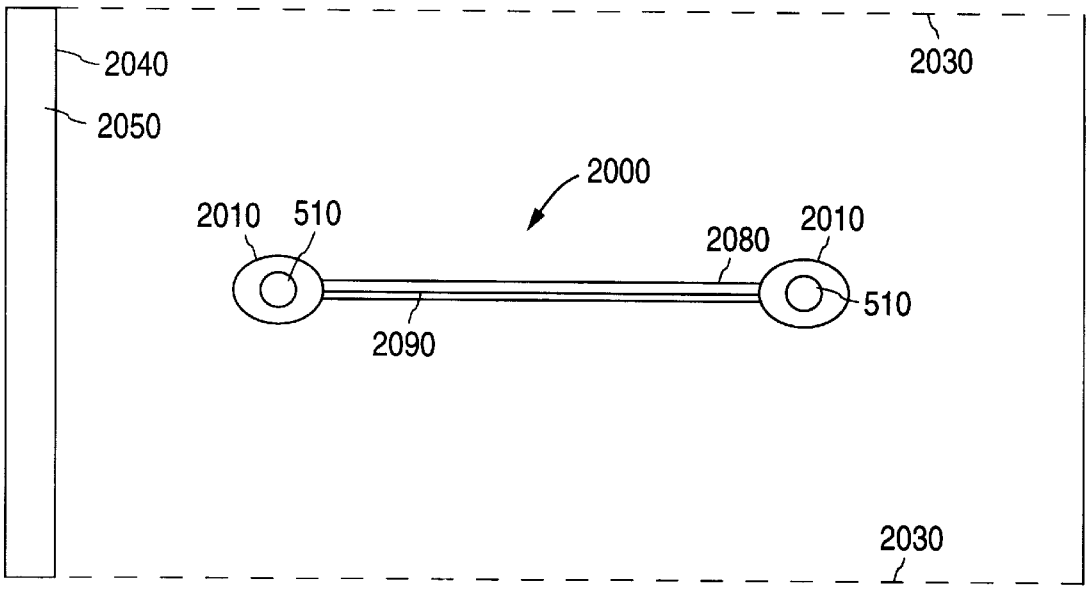
FIG. 20 shows a side view of a modified optical chassis for use in a new exit sign.

FIG. 20 shows an optical chassis 2000 for use in a new emergency exit sign. In new exit signs, a portion of the space normally occupied by sockets may instead hold a voltage converter 2050 disposed within a ballast compartment 2040. Consequently, optical chassis 2000 need only contain one or two optical couplers 2010 for housing lamp(s) 510 along with electrical connectors 2090 disposed within a frame 2080 supporting the elements of optical chassis 2000. An additional electrical connector (not shown in FIG. 20) is used to electrically connect voltage converter 2050 to optical chassis 2000. While FIG. 20 shows two optical couplers 2010, new exit signs have less stringent UL requirements compared with retrofit kits. Also, shadowing by sockets and ballast is not a problem in designing a new exit sign. Consequently, the inventor believes that it is likely that a single lamp 510 housed in an optimized optical coupler 2010 may be sufficient to satisfy the UL requirements for some styles of emergency exit signs and/or arrow direction indicating signs.

The above-described additional applications of the present invention are not intended to be exclusive. The optical coupler and optical chassis of the present invention provide the benefits of: 1) mechanically protecting miniature tube-shaped lamps from shock and vibration; 2) improving the coupling of light from a tube-shaped lamp onto a planar surface; 3) improving as discussed in more detail below, the thermal operating characteristics of the lamps; and 4) providing a convenient apparatus to retrofit pre-existing incandescent lamps with energy-efficient cold cathode fluorescent lamps. Consequently, it is believed that the optical coupler and optical chassis of the present invention will provide a benefit to a wide variety of illumination applications and that optical chassis may be adapted for a variety of illumination applications.

FIGS: 21–23: OPTIMIZATION OF LIFETIME AND UR

The useful lifetime of an illumination source for use in an emergency exit sign is determined by the mean length of time during which it satisfies the UL standard. As the lamps 510 age their light output will gradually diminish. The rate at which the light output decreases with operating lifetime depends on operating current so that it is desirable to operate the lamps at a current level that is below that required to generate their peak light output. Generally, it is desirable that the illumination source, with new lamps, exceed the UL standards by a large margin so that the illumination source satisfies the UL standards during an extended operating lifetime as the lamps gradually dim with age. Thus, improvements in UR and minimum illuminance associated with optimizing the optical design of the optical couplers results in an improvement in operating lifetime.

As previously discussed, a preferred method of manufacturing the optical chassis is as a chambered shell consisting of two molded plastic halves that snap together. Airholes are preferably included in a portion of the ballast chamber to facilitate air cooling of the power supply. A variety of optical plastics may be used to form the shell. Suitable plastics include acrylic, polystyrene, polycarbonate, and copolymer styrene acrylonitrile, although acrylic is a preferred plastic because of its comparatively low cost and durability. Methods for injection molding acyclic plastic are well known. The optical coupler 910 preferably has a SPI (Society of Plastics Industry) finish with a surface quality of SPI #2 or better.

The refractive index of a plastic optical element depends upon its composition. The refractive index is typically characterized at a particular wavelength of light. At a wavelength of 0.64385 microns, acrylic has a refractive index of about 1.4896; polystyrene a refractive index of 1.585808; polycarbonate a refractive index of 1.580734; and copolymer styrene acrylonitrile a refractive index of 1.563438. Consequently, the dimensions and shape of the optical coupler need to be adjusted if the composition of the plastic is varied.

The comparatively simple optical coupler design of the present invention is preferred because it is consistent with a low-cost injection molding process. However, the plastic lens art includes more complex plastic/polymer lens structures and also a variety of reflective coatings (e.g., reflective sunglasses). Other lens and/or reflector configurations could also be used to implement the same function of spreading out the light across the display surface with a reduced UR. Generally, an optical engineer would begin with an optical coupler design intended to spread the light out in a more uniform manner across a display surface. Empirical and/or computer optimization of the optical coupler design, optical coupler separation, and optical coupler spacing would be performed to optimize the UR.

Initial studies by the inventor indicate that the UR in emergency exit signs depends on several factors. The length of the lamps is one factor. It is desirable that the lamps be longer than the length of the letters on a display surface, since longer length lamps tend to improve the UR. The separation distance of the lamps is another factor. It is desirable that they are spaced apart by a substantial distance to improve the UR, but preferably consistent with the different models of box-type exit signs. In the context of a retrofit kit, the pre-existing sockets tend to cause shadowing, particularly at the upper comers of the "T". Consequently the inventor has determined that it is desirable that the center of the chassis be slightly displaced downwards relative to the center of the letters to be illuminated in order to improve the illumination of the "T". The shape of the optical coupler is another factor that strongly affects the UR. The inventor has discovered that all of these factors must be simultaneously optimized in order to achieve acceptable results for a retrofit kit designed to fit a variety of box-type exit signs.

Figure 1:
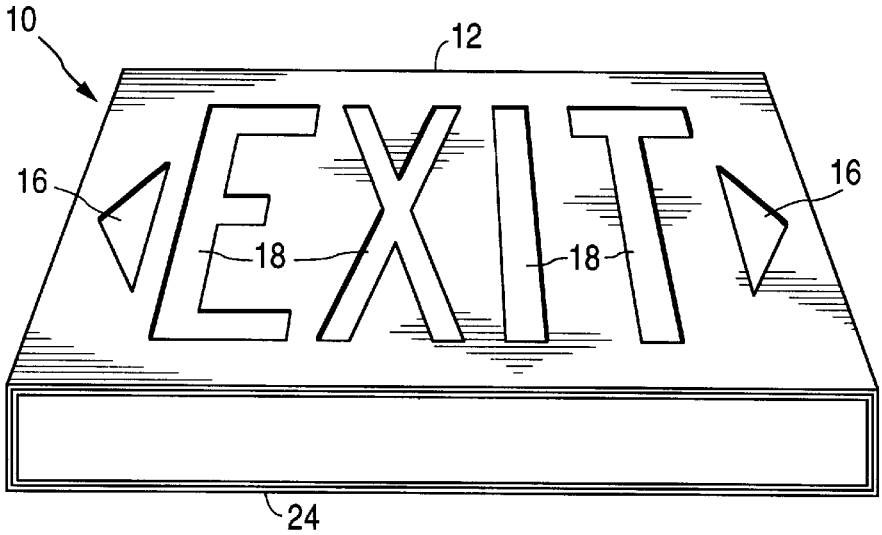
FIG. 1 (PRIOR ART)
FIG. 1 is a perspective view of a portion of a prior art box-type exit sign.
Figure 2:
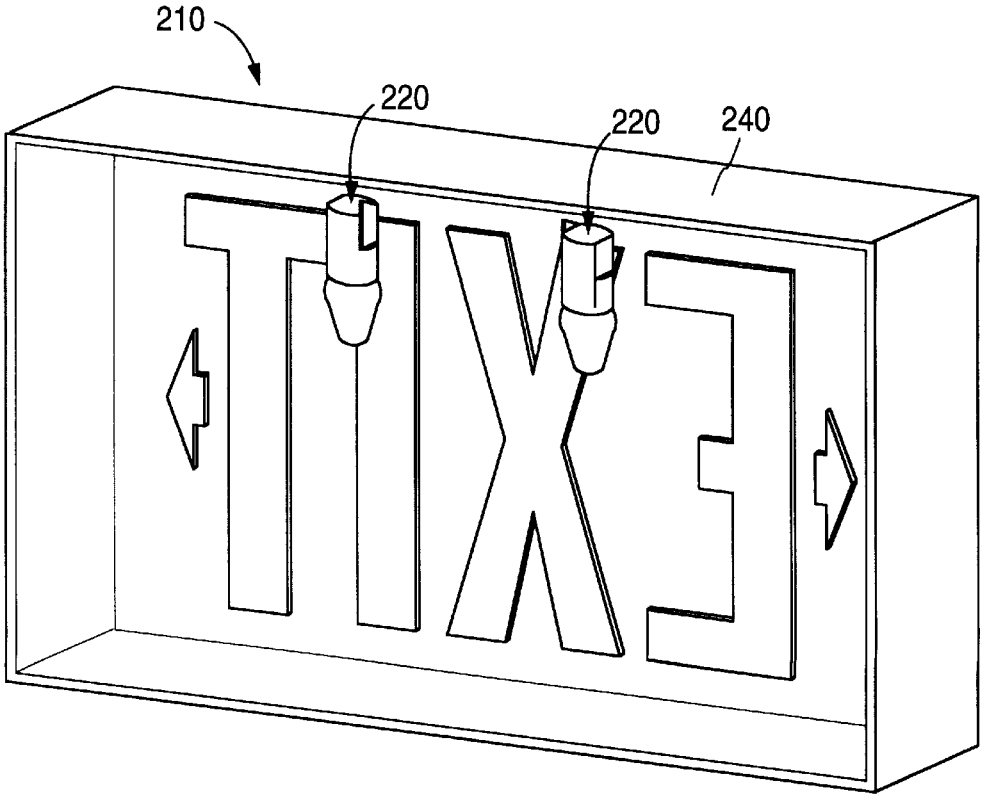
FIG. 2 (PRIOR ART)
FIG. 2 is a rear perspective view of a prior art box-type exit sign with its back surface removed to show the interior illumination source.
Figure 3:
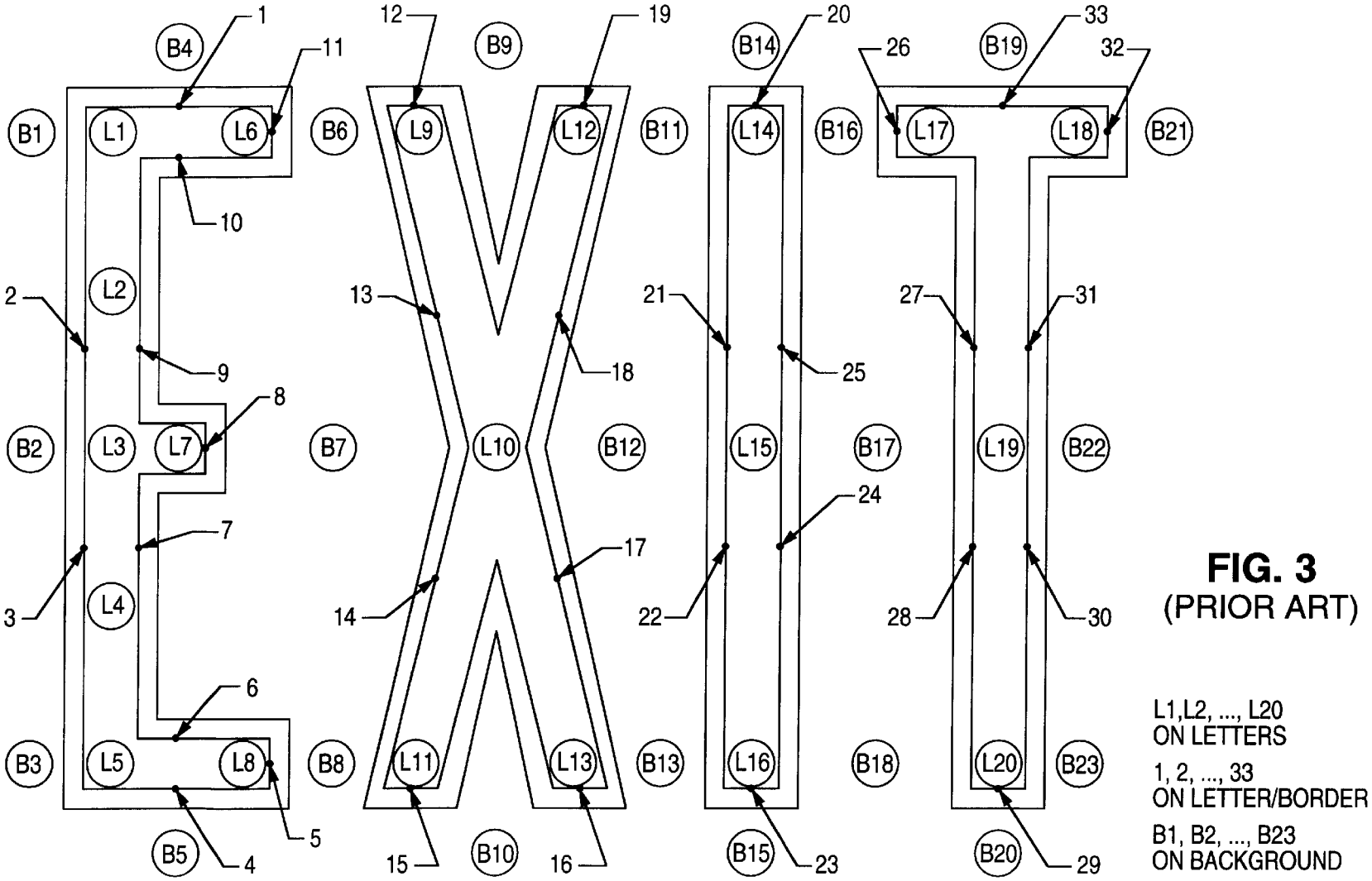
FIG. 3 (PRIOR ART)
FIG. 3 is a plot showing the twenty luminance measurement points along the letters of an exit sign used in the Underwriters Laboratory illumination standard.
Figure 21:
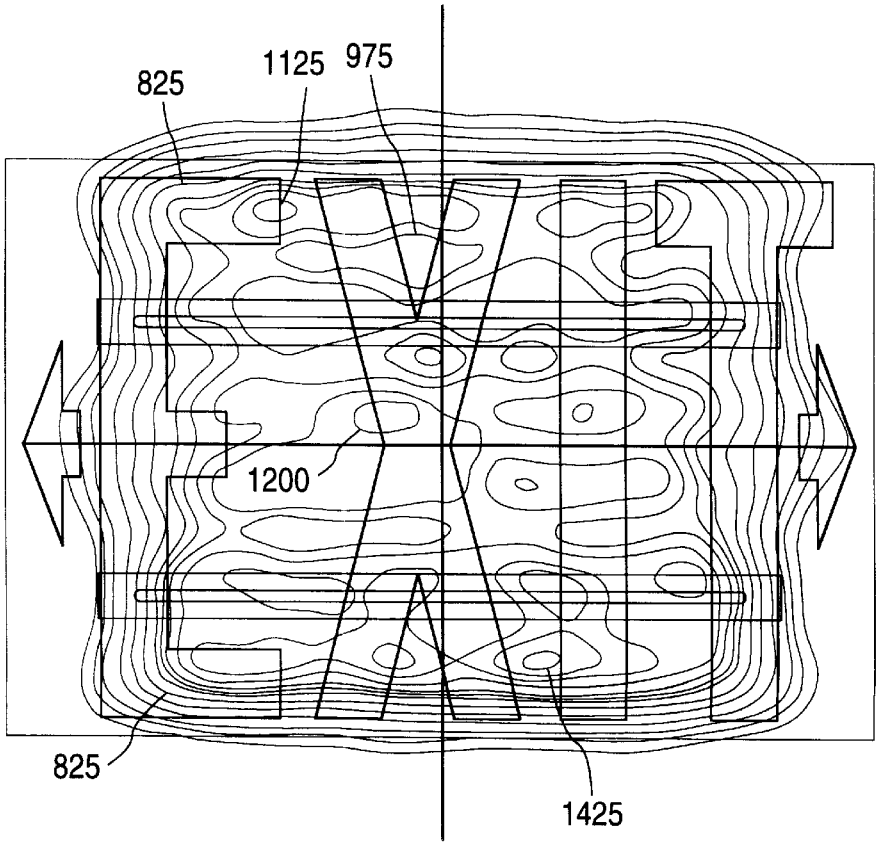
FIGS. 21–23 show calculated constant optical intensity contours superimposed over the exit sign letters for three different design choices.
Figure 22:
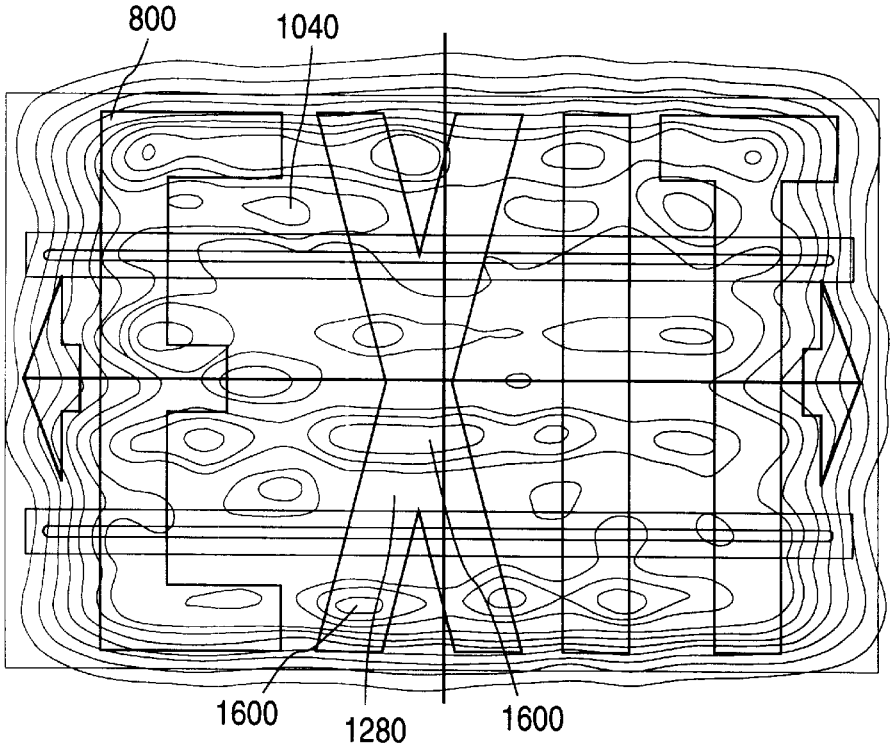
Figure 23:
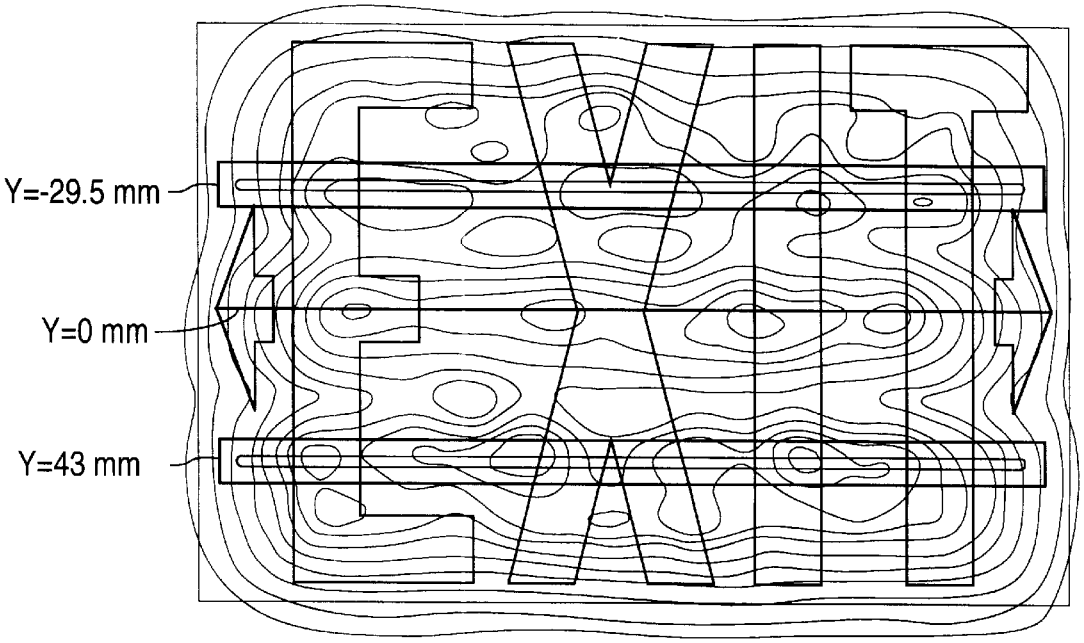

Ray tracing simulations were performed to model the effect of different parameters on optical intensity and uniformity. The ray tracing takes into account the separation between each lamp and the interior surface of the optical coupler; the separation between the optical coupler to the display surface, the separation between optical couplers; and shadowing from residual sockets. FIG. 21 shows a ray tracing simulation for the case that the lamps have a length of 188 mm, which is slightly less than the side-to-side separation of the parallel long segments of the "E" an "T" characters of an exit sign. An outline of the bulb and lenses is superimposed over the exit sign letters. Contours of constant illumination intensity are plotted over the letters, with a numerical value of the illuminance plotted on several contours. The intensity across the upper right portion of the "T" (section L18 of FIG. 3) is unacceptably low for a retrofit kit. FIG. 22 shows a similar plot except with longer, 230 mm tubes. As can be seen in FIG. 22 the illumination uniformity, particularly in the "T" is improved. FIG. 23 shows a contour plot of the preferred embodiment with the lamps and their relative positions shown over the letters. The two cold-cathode lamps each have a diameter of 2.6 millimeters, a length of 230 mm and an output brightness of 115 lumens. There is a strong dependence of the illumination uniformity based upon the spacing of the two tubes relative to the horizontal center-line defined by the centers of the "E" and "X." One tube is preferably 43 mm below the horizontal center-line whereas the other tube is preferably 29.5 mm above the horizontal centerline. There is also a dependence of optical power output based upon how far apart the optical couplers are spaced from the body of the tube. An 80% increase in light output was achieved when the lamps were spaced, by the end caps, about 2 mm from the inner surface of the optical couplers rather than directly contacting the optical coupler. It is speculated that spacing the lamp a short distance from the inner walls of the optical coupler reduces deleterious internal reflection of the light. This configuration also permits the lamp to flex slightly withing the optical enclosure during installation, which reduces the chance of breakage. Moreover, it is believed that this configuration also provides thermal advantages as well, which are discussed in further detail in the following section.

FIGS. 24–25: THERMAL OPTIMIZATION

The use of low power dissipation lamps 510 permits optical couplers 910 to serve as protective housings for lamps 510 without requiring active temperature control of optical couplers 910. This reduces the cost and complexity of the optical chassis. Thermal optimization of the optical chassis is desired to: 1) maintain the optical couplers within a temperature range consistent with the mechanical properties of the material comprising the optical coupler; and 2) assist the lamps to operate in a temperature range corresponding to efficient illumination.

Common optical plastics may be used to fabricate optical couplers 910. The principal limitation of conventional plastics is that the plastic should remain at a temperature well below a temperature at which it softens, which for many common plastics corresponds to a temperatures of less than about 60° C. Typically, plastics have a differential rate of change of refractive index of greater than $10^{-4}$/° C. These characteristics of optical plastics are of particular concern in a variety of optical focusing instruments, such as cameras. However, in the context of the light spreading function of the optical couplers of the present invention, the small refractive index change for plastics in the temperature range of 0° C.-to-60° C. is believed to be unlikely to significantly vary the UR.

The lamps 510 of the present invention, which are partially isolated from the ambient atmosphere by a thin volume of air and the plastic of the housing, can be modeled as thermal sources wrapped in a thin layer of thermal insulation. Thermal equilibrium is achieved when the net power dissipation of the lamps equals thermal heat flow to the ambient environment. The lamps have a low heat-dissipation (e.g., dissipate a fraction of the 4.8 lamp input power) and a have a high surface area. The insulating properties of a small stagnant volume of air and a thin layer of acrylic plastic with a nominal thickness of several millimeters are significant but not extraordinarily high. As a first approximation, the lamp can be modeled as a heat dissipation source covered by a thin annular cylinder of insulation.

Figure 24:
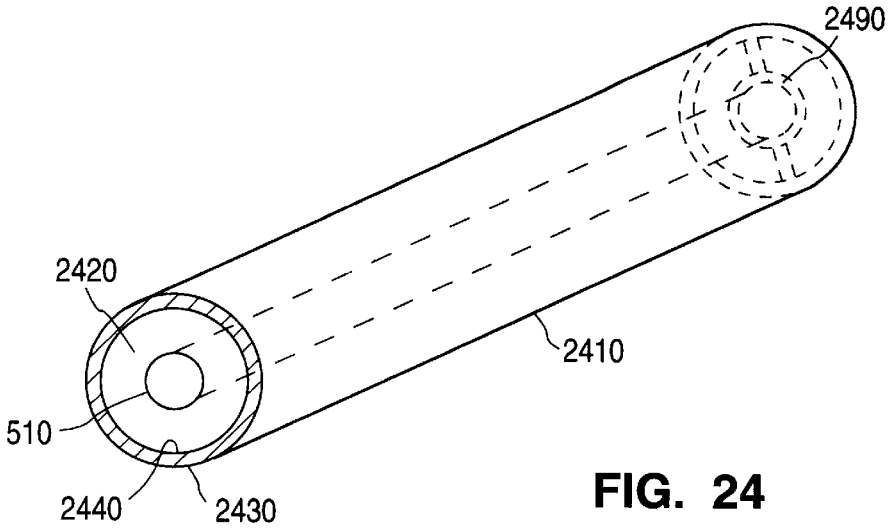
FIG. 24 shows a thermally-equivalent structure used to model the thermal characteristics of the optical couplers of the present invention.

FIG. 24 shows a structure that is the thermal equivalent of a single optical coupler 910 of the present invention. The optical coupler 910 and lamp 510 can be modeled as a lamp 510 held by end caps (or spacers) 2490 (shown in phantom) in the center of a cylinder 2410 comprised of an insulating material with a small difference in the radius of an inner wall 2440 and an outer wall 2430. The end-caps 1800 of the present invention maintain lamp 510 in the center of cylinder 2410 so that there is no significant direct thermal conduction of heat from lamp 510. Consequently, when lamp 510 is turned-on, it will initially increase in temperature, with its rate of temperature increase limited by its thermal mass (i.e., $\Delta T=\Delta Q R_T$, where $\Delta T$ is the temperature rise, $\Delta Q$ is the power dissipated over a short time interval, and $R_T$ is the thermal mass of the lamp). Air in annular region 2420 separating lamp 510 from inner wall 2440 of cylinder 2410 will couple heat from lamp 510 to the inner wall 2440 of cylinder 2410 by convection. Since the wall thickness of cylinder 2410 is thin (i.e., several millimeters of acrylic), significant heat may flow from inner wall 2440 to outer wall 2430 once a thermal gradient is established between the interior and exterior surfaces 2440, 2430 of the insulating medium. Consequently, when the lamp is turned on the temperature in the lamp enclosure will quickly rise to a temperature at least several degrees Celsius higher than the ambient atmospheric temperature while remaining safely below a safe operating temperature of the plastic comprising the optical coupler. The quasi-steady temperature increase may be adjusted by appropriate selection of the operating power of the lamp, the size of the air gap in annular region 2420, and the equivalent insulating thickness of cylinder 2410.

Cold cathode fluorescent lamps function most efficiently in a temperature range of about 25–30° C., which corresponds to a temperature range for which the operating voltage decreases and the light output increases. Since no heaters are required for the efficient operation of the cold cathode lamps of the present invention, it is believed by the inventor that the thermal properties of the preferred optical chassis are such that the lamps operate at a temperature between about 25–30° C. (i.e., 5–10° C. higher than room temperature). This fortuitously corresponds to a near-optimal temperature range for high efficiency illumination of exit signs used in temperature-controlled office buildings.

Figure 25:
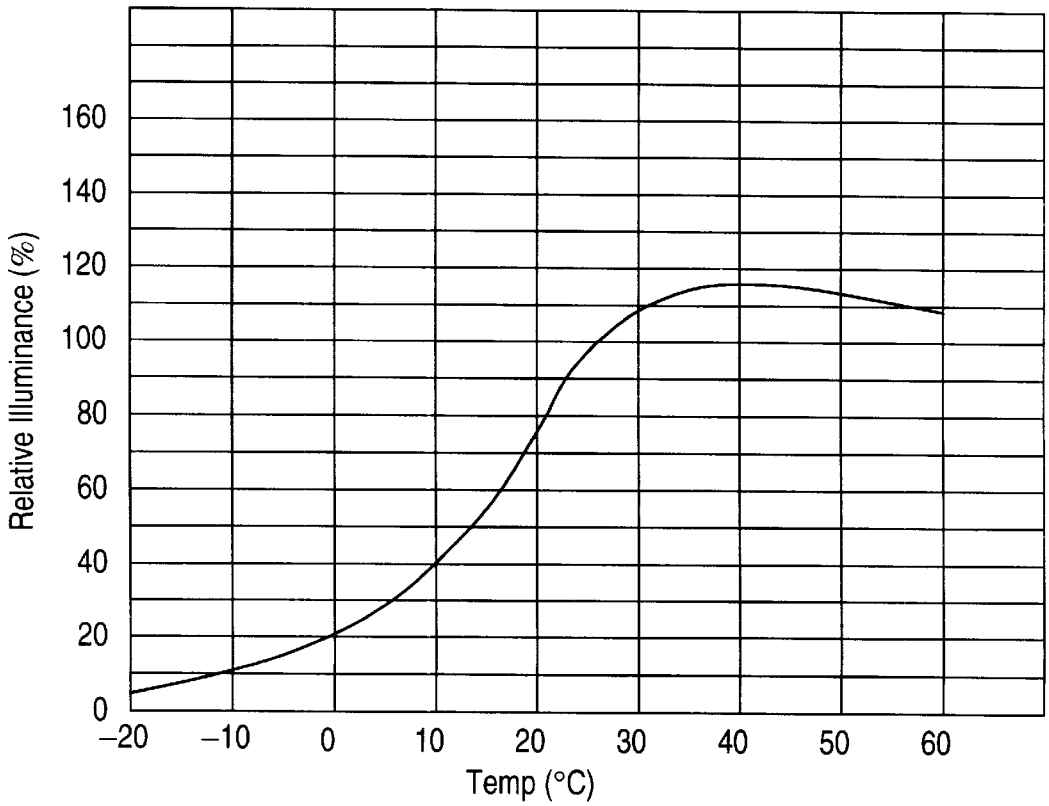
FIG. 25 (PRIOR ART)
FIG. 25 is a prior art plot of the light output of cold cathode fluorescent lamp versus operating temperature.

FIG. 25 is a plot of the relative illuminance of a CCFL lamp versus ambient temperature. The light output of a CCFL rises sharply from zero degrees Celsius and plateaus in a temperature range between about twenty-five to sixty degrees Celsius. The operating voltage also decreases as the temperature increases, resulting in improved efficiency. Consequently, it is desirable that the steady-state lamp temperature be about five-to-twenty degrees Celsius above ambient depending upon the particular application. For example, light output increases from 75% to about 108% if the steady-state lamp temperature is about ten degrees Celsius above room temperature (i.e., from twenty-to-thirty degrees Celsius). However, the thermal characteristics of the optical chassis could be further modified for other applications. For example, for an unheated warehouse the thickness of the plastic comprising the optical housing could be increased to reduce the coupling of heat to the atmosphere so that the lamps operate at a quasi-steady state temperature of about ten-to-twenty degrees higher than the ambient temperature of the warehouse. In some cases, such as a refrigerated food storage facility, the insulative properties of the optical coupler could be further increased for even larger temperature increases (e.g., twenty-to-forty degrees Celsius above ambient).

The thermal characteristics of the optical couplers 910 may also be tailored to improve the light output of emergency signs which flash in an emergency notification mode. Although most emergency exit signs are operated in a continuous mode, signs which flash on and off in emergencies or during power failures are also used in some geographic areas. Referring again to FIG. 24, in the present invention low thermal conductivity end-caps 2490 center the lamps 510 in the chambers of the optical couplers so that there is no significant direct thermal conduction of heat from lamps 510 to the walls 2430, 2440 of the enclosure 2410. Consequently, when lamp 510 is turned-on, its temperature will initially increase rapidly until the lamp temperature rises high enough for significant heat to be coupled by convection in annular region 2420 to inner wall 2440. The thermal mass of a CCFL with a diameter less than three millimeters is comparatively low. Consequently, the inventor believes that the thermal time constant required for lamp 510 to increase in temperature by five-to-ten degrees Celsius is a fraction of a second. This makes the optical coupler 910 useful for the efficient illumination of flashed emergency exit signs and/or for flashed displays used in other applications (e.g., advertisement displays).

Additionally, it is believed that the thermal principles of optical coupler 910 are useful in other CCFL applications. As discussed in the parent application of the present application, CCFLs are of interest for use in stop lights. While FIG. 24 is a thermal model for an optical coupler 910 of the present invention, it is also applicable for modeling the thermal characteristics of an optical enclosure 2410 used in traffic stop lights in which, as indicated in FIG. 4, a lamp 410 is protected by a protective tube 420. Referring to FIG. 24, the thickness (i.e., difference in radius of walls 2430, 2340) of an lamp housing 2410 may be increased, as required, to achieve a selected temperature differential of lamp 510 relative to ambient. For example, in many climactic zones, a quasi-steady state differential temperature increase of a cold cathode fluorescent lamp 410 of about twenty-degrees above ambient is sufficient to maintain lamp 410 in a high-efficiency mode of operation during normal seasonal variations, eliminating the need for additional temperature sensing and control elements.

In summary, the present invention comprises an optical chassis for use in display signs, such as emergency exit signs. The optical chassis has optical couplers that house miniature lamps and which also transform the radial distribution of the lamps into a more uniform luminance on planar display surfaces. In an embodiment for use as an emergency exit sign retrofit kit, two spaced apart lamps are included in the optical chassis. A ballast circuit is also included in the optical chassis. Placing the ballast in the optical chassis reduces deleterious shadowing. The optical chassis of the present invention reduces the power consumption, improves the illumination uniformity ratio, and increases the illumination intensity of emergency exit signs. While the optical chassis of the present invention is directed towards retrofitting existing emergency exit signs, the optical chassis may be used in new exit signs and/or in other display sign applications.

Although a preferred embodiment of the present invention and modifications thereof have been described in detail herein, it is to be understood that this invention is not limited to those precise embodiments and modifications, and that other modifications and variations may be affected by one of ordinary skill in the art without departing from the spirit and scope of the invention as defined in the appended claims.

What is claimed is:

1. An optical chassis for illuminating a planar surface region adjacent the optical chassis, comprising;

a frame;

an optical coupler having an inner chamber and an outer surface profile and mechanically coupled to said frame;

a tube-shaped lamp having a length and disposed in said chamber, where said lamp emits light rays each having a trajectory;

a mechanical coupler to suspend said lamp within said inner chamber while permitting the lamp to flex along its length in response to vibration; and an emergency exit sign positioned to intersect at least some of said light rays, wherein optical characteristics of said optical coupler are selected to alter the trajectory of light rays emitted from said lamp as the light rays pass through said optical coupler for substantially improving the illumination uniformity at the planar surface region compared to the illumination uniformity of the lamp alone, and wherein said selected optical properties alter the trajectory of light rays to illuminate said emergency exit sign with a uniformity ratio across said emergency exit sign of at most 50:1.

2. The optical chassis of claim 1, wherein said lamp comprises a miniature cold-cathode fluorescent lamp.

3. The optical chassis of claim 1, wherein said selected optical characteristics include the refractive index of the optical coupler and outer surface profile, and wherein said selected optical characteristics are selected for substantially improving the illumination uniformity over a portion of the planar surface region.

4. An optical chassis for illuminating a planar surface region adjacent the optical chassis, comprising:

a frame;

a first optical coupler having a first inner chamber and a first outer surface profile and mechanically coupled to said frame;

a first tube-shaped lamp having a length and disposed in said first inner chamber, where said first lamp emits light rays each having a trajectory;

a first mechanical coupler to suspend said first lamp within said first inner chamber while permitting said first lamp to flex along its length in response to vibration;

a second optical coupler mechanically coupled to said frame and spaced apart from said first optical coupler by a separation distance, said second optical coupler having a second outer surface and a second inner chamber;

a second tube-shaped lamp disposed in said second chamber, where said second lamp emits light rays each having a trajectory; and a second mechanical coupler to suspend said second lamp within said second chamber;

wherein optical characteristics of said first and second optical couplers, and said separation distance are selected to alter the trajectory of light rays emitted from said first and second lamps as the light rays pass through said first and second optical couplers for substantially improving the illumination uniformity at the planar surface compared to the illumination uniformity of said first and second lamps alone.

5. The optical chassis of claim 4, further including a box-type exit sign having an emergency exit sign display surface, wherein said frame is adapted to fit within said box-type exit sign, and wherein said planar surface region includes said emergency exit sign display surface.

6. The optical chassis of claim 5, wherein the illumination uniformity ratio across said emergency exit sign display surface is at least as low as 20:1.

7. The optical chassis of claim 6, further comprising:

a ballast compartment coupled to said frame and disposed between said optical couplers;

a voltage converter disposed within said ballast compartment; and electrical connections between said voltage converter and each said optical coupler.

8. The optical chassis of claim 7, further comprising:

a mounting connector coupled to said frame for locking said optical chassis into place in said box-type exit sign.

9. An optical illumination source for illuminating display surfaces of a box-type emergency exit sign, comprising:

a chambered shell formed from a molded optical plastic having a first chamber shaped to form an optical coupler;

a first lamp disposed in said chamber, where said first lamp emits light rays each having a trajectory;

electrical connectors disposed in said chambered shell to couple electrical power to said first lamp;

a second chamber shaped to form a second optical coupler and spaced apart from said first optical chamber;

a second lamp disposed in said second chamber, where said second lamp emits light rays each having a trajectory, and wherein said first and second lamp are separated by a separation distance;

wherein the refractive index and shape of said first and second optical chambers and said separation distance are selected to form optical couplers that alter the trajectory of light rays emitted from said lamp as the light rays pass through said first and second optical couplers for achieving a uniformity ratio of less than 20:1 on the display surfaces of the exit sign.

10. The optical illumination source of claim 9, where said first and second chambers each have a center, and further comprising: two mechanical couplers to support said first lamp in the center of said first chamber and said second lamp in the center of said second chamber.

11. The optical illumination source of claim 10, wherein said mechanical couplers comprise resilient end caps.

12. The optical illumination source of claim 9, further comprising:

a mechanical connector to couple said illumination source to an exit sign.

13. An illumination source utilizing two high-frequency tube-shaped lamps powered from a voltage line for uniformly illuminating letters, symbols, or indica on a display surface, said source comprising:

a frame;

a ballast compartment coupled to said frame;

a switch-mode AC-to-AC power converter disposed in said ballast compartment for converting said line voltage into a high voltage output;

a first optical coupler connected to said frame and having a first enclosed chamber;

a first lamp disposed in said first chamber;

a second optical coupler connected to said frame and having a second enclosed chamber, where said first and second optical couplers are separated by a separation distance;

a second lamp disposed in said second chamber;

electrical connections disposed on said frame between the output of said power converter to said first lamp;

electrical connections disposed on said frame between the output of said power converter to said second lamp;

wherein the separation, the position of said ballast compartment on said frame, and optical characteristics of said first and second optical couplers are selected for substantially improving the illumination uniformity on the display surface compared to the illumination uniformity of the display surface from two lamps alone.

14. The illumination source of claim 13, wherein said display surface is an exit sign of a box-type exit sign, and further comprising: mechanical connectors coupled to said frame for mounting said frame within the box-type exit sign.

15. The illumination source of claim 14, wherein the illumination uniformity ratio across the display surface of the exit sign is less than 20:1.

16. The illumination source of claim 13, further including a mechanical coupler, wherein said first and second chambers each has a center, and wherein each said mechanical coupler supports said first lamp in the center of said first chamber and supports said second lamp in the center of said second chamber.

17. The illumination source of claim 13, further comprising: a plurality of resilient end-caps to support the lamps in the center of a corresponding chamber.

18. An optical housing with thermal properties selected to efficiently operate a miniature cold-cathode fluorescent lamp as a pulsed or continuous illumination source, comprising:

a lamp enclosure forming a chamber with a minimum inner diameter and having chamber walls with an average thickness;

a cold cathode fluorescent lamp with a diameter less than the minimum diameter of said chamber; and a mechanical coupler to suspend said lamp in the chamber so that there is no direct thermal conduction of heat from the surface of said lamp to said housing;

wherein power dissipation of said lamp, the size of said chamber, and the thickness of the chamber walls are selected so that said lamp has a quasi-steady state operating temperature that is selected to be between five-to-forty degrees Celsius above the ambient thermal environment.

19. The housing of claim 18, wherein said operating temperature is less than about twenty degrees Celsius above ambient.

20. The housing of claim 18, wherein said lamp has a diameter of less than or equal to about three millimeters.

* * * * *